US007121937B2

(12) United States Patent
Turch et al.

(10) Patent No.: US 7,121,937 B2
(45) Date of Patent: Oct. 17, 2006

(54) ABRASIVE BRUSH ELEMENTS AND SEGMENTS

(75) Inventors: Steven E. Turch, Blaine, MN (US); Richard M. Pihl, Cottage Grove, MN (US); Kent E. Lageson, Burnsville, MN (US); Jeff S. Shaw, Fridley, MN (US); Kris A. Beardsley, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/389,788

(22) Filed: Mar. 17, 2003

(65) Prior Publication Data

US 2004/0185762 A1 Sep. 23, 2004

(51) Int. Cl.
*B24D 13/10* (2006.01)

(52) U.S. Cl. ..... 451/526; 451/466

(58) Field of Classification Search ..... 451/177, 451/466, 486, 489, 526, 527, 529
See application file for complete search history.

(56) References Cited

U.S. PATENT DOCUMENTS

| | | | | |
|---|---|---|---|---|
| 2,821,729 | A | 2/1958 | Van Clief, Jr. | |
| 2,877,481 | A | 3/1959 | Van Clief, Jr. | |
| 3,080,657 | A | 3/1963 | Lanski | |
| 3,641,611 | A * | 2/1972 | Schofield | 15/180 |
| 3,643,281 | A * | 2/1972 | Schofield | 15/181 |
| 3,851,350 | A | 12/1974 | Schofield | |
| 4,307,479 | A | 12/1981 | Mertes et al. | |
| 4,422,986 | A | 12/1983 | Cole | |
| 4,651,393 | A * | 3/1987 | Dilo et al. | 28/111 |
| 4,989,166 | A | 1/1991 | Akasaka et al. | |
| 5,045,091 | A | 9/1991 | Abrahamson et al. | |
| 5,143,424 | A | 9/1992 | Boucherie | |
| 5,400,458 | A | 3/1995 | Rambosek | |
| 5,438,728 | A | 8/1995 | Kubes et al. | |
| 5,478,510 | A | 12/1995 | Möltgen et al. | |
| 5,575,704 | A | 11/1996 | Hotani | |
| D378,003 | S | 2/1997 | Eichinger et al. | |
| D378,004 | S | 2/1997 | Wilson et al. | |
| 5,632,790 | A | 5/1997 | Wiand | |
| D381,139 | S | 7/1997 | Johnson et al. | |
| 5,679,067 | A | 10/1997 | Johnson et al. | |
| 5,709,591 | A | 1/1998 | Warner et al. | |

(Continued)

FOREIGN PATENT DOCUMENTS

DE 37 11 181 A1 10/1988

(Continued)

OTHER PUBLICATIONS

Book Excerpt: Malloy, *Plastic Part Design for Injection Molding*, Carl Hanser Verlag (1994), pp. 40-41 & 44.

*Primary Examiner*—David B. Thomas

(57) ABSTRACT

A brush segment, a brush element, a brush assembly, and methods of making and using the same are disclosed. The brush segment includes a center portion with inner and outer edges. The center portion also includes first and second side edges. A plurality of bristles extends outwardly from the outer edge. The inner edge includes an interlock arrangement. The side edges have an attachment arrangement for attaching adjacent segments. The brush element includes a center portion and inner and outer edges. A plurality of bristles extends outwardly from the outer edge. The inner edge includes an interlock arrangement for restraining rotation of adjacent elements assembled into a brush assembly. Two or more brush elements are secured together to form a rotary brush assembly.

48 Claims, 14 Drawing Sheets

U.S. PATENT DOCUMENTS

| | | | | |
|---|---|---|---|---|
| 5,756,017 | A | 5/1998 | Togawa et al. | |
| 5,849,052 | A | 12/1998 | Barber, Jr. | |
| 5,903,951 | A * | 5/1999 | Ionta et al. | 15/180 |
| 5,915,436 | A * | 6/1999 | Johnson et al. | 15/187 |
| 5,928,589 | A | 7/1999 | Norota et al. | |
| 5,938,515 | A | 8/1999 | McLain et al. | |
| 5,964,006 | A | 10/1999 | Holmes et al. | |
| 5,966,771 | A | 10/1999 | Stroud | |
| 5,983,434 | A | 11/1999 | Eichinger et al. | |
| 6,012,971 | A | 1/2000 | Friel, Sr. | |
| D424,258 | S | 5/2000 | Pihl et al. | |
| D424,765 | S | 5/2000 | Lund et al. | |
| D425,269 | S | 5/2000 | Pihl et al. | |
| 6,069,080 | A | 5/2000 | James et al. | |
| D427,395 | S | 6/2000 | Pihl et al. | |
| 6,083,445 | A | 7/2000 | Warner et al. | |
| 6,095,910 | A | 8/2000 | Luedeke | |
| 6,126,533 | A | 10/2000 | Johnson et al. | |
| 6,129,620 | A | 10/2000 | Warner et al. | |
| 6,138,317 | A | 10/2000 | Holmes et al. | |
| 6,163,917 | A | 12/2000 | Bown | |
| 6,174,600 | B1 | 1/2001 | Brown et al. | |
| 6,179,887 | B1 | 1/2001 | Barber, Jr. | |
| 6,261,156 | B1 | 7/2001 | Johnson et al. | |
| 6,261,167 | B1 | 7/2001 | Watson et al. | |
| 6,352,471 | B1 * | 3/2002 | Bange et al. | 451/527 |
| 6,413,287 | B1 * | 7/2002 | Barber, Jr. | 51/298 |
| 6,422,932 | B1 * | 7/2002 | Lageson et al. | 451/466 |
| 6,431,971 | B1 * | 8/2002 | Nagafuchi | 451/496 |
| 6,730,140 | B1 * | 5/2004 | Lageson et al. | 51/298 |
| 2001/0007161 | A1 | 7/2001 | Masterman et al. | |
| 2001/0051858 | A1 | 12/2001 | Liang et al. | |
| 2002/0192621 | A1 * | 12/2002 | Ben-Ari | 433/216 |

FOREIGN PATENT DOCUMENTS

| | | |
|---|---|---|
| DE | 296 20 104 U 1 | 4/1998 |
| DE | 198 18 499 A 1 | 1/1999 |
| DE | 198 43 583 A 1 | 4/2000 |
| EP | 0 724 499 B1 | 8/1996 |
| FR | 2 735 336 A1 | 12/1996 |
| GB | 223163 | 10/1924 |
| JP | 11-165266 | 6/1999 |
| WO | WO 00/33761 | 6/2000 |
| WO | WO 00/71297 A1 | 11/2000 |
| WO | WO 01/15867 A1 | 3/2001 |

* cited by examiner

ABRASIVE BRUSH ELEMENTS AND SEGMENTS

FIELD

The present disclosure generally relates to brushes, and in particular to abrasive brushes.

BACKGROUND

Brushes are used for many applications, for example, polishing, cleaning, and abrading a wide variety of substrates or work surfaces. Such brushes typically have an abrasive surface or area that contacts the substrate and removes material from the substrate. Bristle brushes are one type of abrasive brush, and rotary bristle brushes remove material by contacting the substrate when the brush is rotating, typically at a high rotational speed. Abrasive particles can be added to brushes to modify their abrasive qualities. Bristle brushes can have abrasive particles on the surface of the bristles, dispersed throughout the bristles, or a combination thereof.

SUMMARY

An aspect of the present disclosure is directed to a brush element. The brush element includes a generally planar center portion having an outer edge and an inner edge. A plurality of bristles extend from the outer edge. An interlock arrangement is located at the inner edge configured to interlock the brush segment with a second brush segment.

Another aspect of the present disclosure is a method of making a brush element. A mold structure is defined for molding a brush element having a generally planar center portion having an outer edge and an inner edge, a plurality of bristles extending from the outer edge, and an interlock arrangement located at the inner edge, configured to interlock the molded brush element with a second molded brush segment. A moldable material is heated until it becomes sufficiently fluid to flow under pressure. The material in its sufficiently fluid state is then injected into the mold structure to form a brush element.

Another aspect of the present disclosure is directed to a brush element. The brush element includes a plurality of interlocked brush segments. Each brush segment includes a generally planar center portion having an outer edge and an inner edge, a first side edge and a second side edge. Each segment further includes a first side attachment arrangement located at the first side edge and a second side attachment arrangement located at the second side edge. Each segment further includes a plurality of bristles extending from the outer edge and an interlock arrangement located at the inner edge. A circularly shaped brush element is made by interlocking adjacent brush segments with their respective attachment arrangements.

Another aspect of the present disclosure is directed to a rotary brush assembly. The rotary brush assembly includes at least two adjacent brush elements. Each brush element includes a plurality of interlocked brush segments. Each brush segment includes a generally planar center portion having an outer edge and an inner edge, a first side edge and a second side edge. Each brush segment further includes a first side interlock mechanism located at the first side edge and a second side interlock mechanism located at the second side edge. Each brush segment further includes a plurality of bristles extending from the outer edge and an interlock arrangement located at the inner edge. The plurality of brush segments are interlocked to form a circular shape.

Another aspect of the present disclosure is directed to a brush assembly. The brush assembly includes a first brush element and a second brush element. Each brush element includes a generally planar portion having an inner edge and an outer edge, with the planar portion having a first surface and a second surface. Each brush element also includes a plurality of bristles extending outwardly from the outer edge, an interlock arrangement disposed at the inner edge, and at least one raised member extending from the first surface of each element. A cavity corresponds to each raised member and is located on the second surface opposite where each raised member is located. The interlock arrangements cooperate to keep the first and second elements from rotating relative to each other. Each raised member on the first element is received into a corresponding cavity on the second element.

Another aspect of the present disclosure is directed to a molded brush element. The molded brush element includes a generally planar portion having an inner edge and an outer edge. The planar portion also includes a first surface and a second surface. A plurality of bristles extends outwardly from the outer edge. The molded brush element also includes an interlock arrangement disposed at the inner edge, a plurality of raised members extending from the first surface, and a cavity corresponding to each raised member. Each cavity is located on the second surface opposite where each raised member is located.

BRIEF DESCRIPTION OF THE DRAWINGS

The present disclosure will be further explained with reference to the appended Figures wherein like structure is referred to by like numerals throughout the several views, and wherein.

DETAILED DESCRIPTION

In the following detailed description, reference is made to the accompanying drawing that forms a part hereof, and in which is shown by way of illustration exemplary embodiments in which the disclosure may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Generally, the present disclosure is directed to a brush element for an abrasive brush. The brush element includes an outer section including bristles and an inner section including an interlocking arrangement for interlocking adjacent brush elements when multiple brush elements are included in a brush assembly. Individual brush elements can further comprise two or more individual brush segments. Adjacent brush segments are held together using a segment attachment arrangement. A plurality of brush elements can be stacked to create a brush assembly. The brush assembly can be used to condition a surface, such as in a rotary tool.

Figure 1:
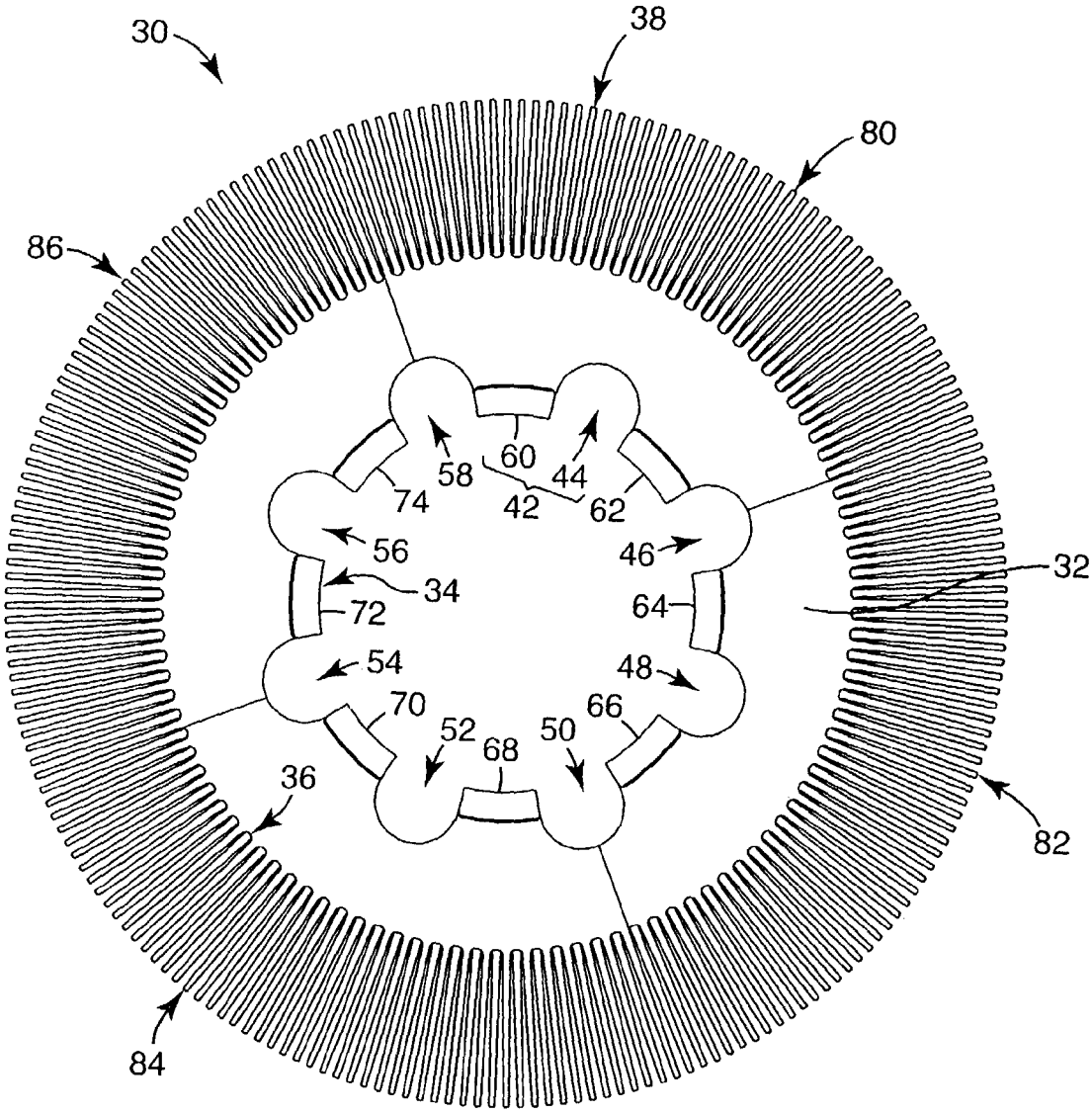
FIG. 1 is a plan view illustrating an exemplary embodiment of a brush element according to the present disclosure.

Referring to FIG. 1, an exemplary embodiment of a brush element according to the present disclosure is shown. Brush element 30 includes a generally circular center portion 32 having an inner edge 34 and an outer edge 36. A plurality of bristles 38 extend outwardly from outer edge 36. An interlock arrangement 42 is located at the inner edge 34. Interlock arrangement 42 is configured to interlock molded brush element 30 with an adjacent brush element. Brush element can be made having unitary center portion 32, and can also be made from two or more brush segments 80, 82, 84, 86. Adjacent brush segments, (e.g., 80, 82) are held together by an attachment arrangement (e.g., 102 in FIG. 2).

Brush element 30 or brush segment 80 can be made from a moldable polymeric material, several examples of which will be described hereinafter. Alternatively, each brush element or segment could be cast or made by other techniques known in the art. The material of the brush element 30 or segment 80 can also include abrasive particles. The particles can be on the bristle 38 surface or distributed throughout the bristle 38. Desirably, brush element 30 is molded, such that bristles 38 and center portion 32 are continuous with one another. Interlock arrangement 42 is also operable as a mold gate interface, configured to improve mold material flow (as will be described hereinafter) from the inner edge 34 to the outer edge 36 during molding of brush element 30.

In one exemplary embodiment, interlock arrangement 42 includes an engaging member (e.g., 60) and a receiving area (e.g., 44) located at or near the inner edge 34. Interlock arrangement 42 engages a complementary interlock arrangement on adjacent brush element or elements to keep the brush elements from rotating relative to one another when the brush elements are stacked in a brush assembly.

In exemplary embodiment shown, brush element 30 includes a plurality of receiving areas 44, 46, 48, 50, 52, 54, 56, 58 extending from the inner edge 34 into the center portion 32. One or more receiving areas form part of the interlock arrangement 42. Brush element 30 further includes a plurality of engaging members 60, 62, 64, 66, 68, 70, 72, 74 positioned along the inner edge 34. In one aspect, each engaging member is positioned along the inner edge 34 between two receiving areas. Interlock arrangement 42 includes at least one receiving area (e.g., receiving area 44) and at least one engaging member (e.g., engaging member 60).

In addition to the interlock arrangement 42, the brush element can also include an array of raised portions or members 85, for example, bosses, to assist in alignment of adjacent brush elements. Each raised portion 85 would have a corresponding receiving cavity (not shown) on the surface opposite the surface having the raised portions 85. Each raised portion 85 would be received into a respective receiving cavity of an adjacent element. Engagement of each raised portion 85 into its respective receiving cavity would assist in alignment of adjacent brush elements in creating bristle patterns (as described hereinafter) and also cooperate with the interlock arrangement to prevent relative rotation of adjacent brush elements. Desirably, the raised portions 85 are spaced radially around each brush element with the same spacing interval as the interlock arrangement. It is also possible to use the raised portions and receiving cavities on adjacent brush elements, without an interlock arrangement, to keep the adjacent elements from rotating relative to one another.

Figure 2:
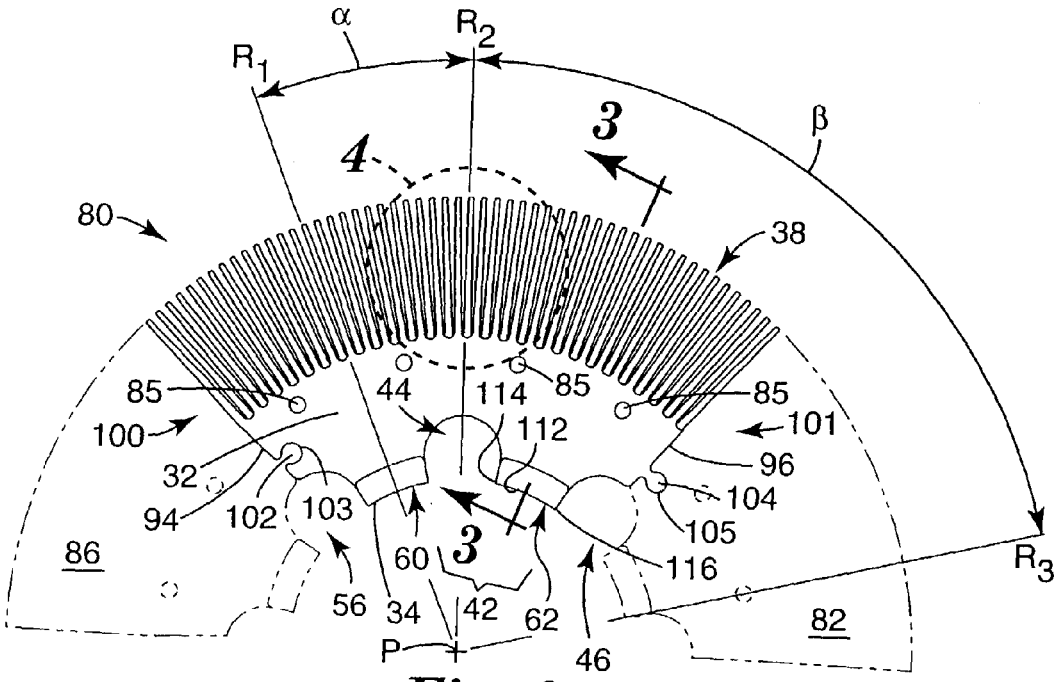
FIG. 2 is a plan view illustrating an exemplary embodiment of a brush segment according to the present disclosure.
Figure 3:
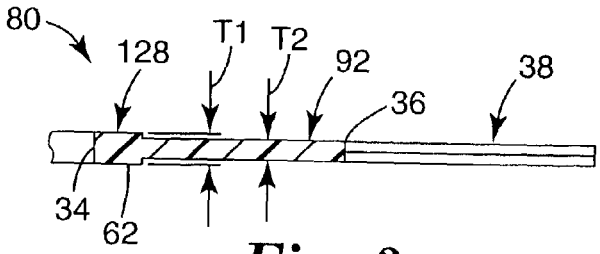
FIG. 3 is a cross-sectional view of the brush segment of FIG. 2, taken along line 3—3.

Brush element 30 can be made up of a plurality of brush segments 80, 82, 84, 86. Each molded brush segment 80, 82, 84, 86 can include bristles 38 and center portion 32 that are continuous with one another. Referring to FIG. 2, an exemplary embodiment of brush segment 80 is shown. Brush segment 80 is similar to brush segment 82, brush segment 84 and brush segment 86 (as shown in FIG. 1). Desirably, the brush segments in an element are congruent. Brush segment 80 includes a generally planar segment center portion 92 (FIG. 3). Center portion 92 extends in a generally arcuate shape between first and second side edges 94, 96. Bristles 38 extend radially outward from outer edge 36 of segment center portion 92. Interlock arrangement 42 is located at the inner edge 34 of segment center portion 92.

Adjacent brush segments are held together by a cooperating attachment arrangement 100, 101. Brush segments 80, 86 are held together by a first attachment arrangement 100 near side edge 94 of center portion 32. Brush segments 80, 82 are held together by a second attachment arrangement 101 near side edge 96 of center portion 32. Individual brush segments are attached to adjacent brush segments to form a brush element. In the exemplary embodiment shown (FIGS. 1 and 2), brush segments 80, 82, 84, 86 are attached to adjacent elements to form brush element 30. An additional way for holding adjacent segments can also be added along with the attachment arrangement, for example, welding the seam between segments or spot gluing.

In the exemplary embodiment shown, attachment mechanisms 100, 101 are configured to operably interlock brush segment 80 with adjacent brush segments 82, 86. Attachment arrangement 100 holding brush segments 80, 86 together includes a first attachment member 102 received into a first holding area 103. Attachment arrangement 101 holding brush segments 80, 82 together includes a second attachment member 104 received into a second holding area 105. One of skill in the art will recognize that various suitable attachment arrangements can be used to hold together multiple adjacent brush segments to form a brush element.

Figure 13:
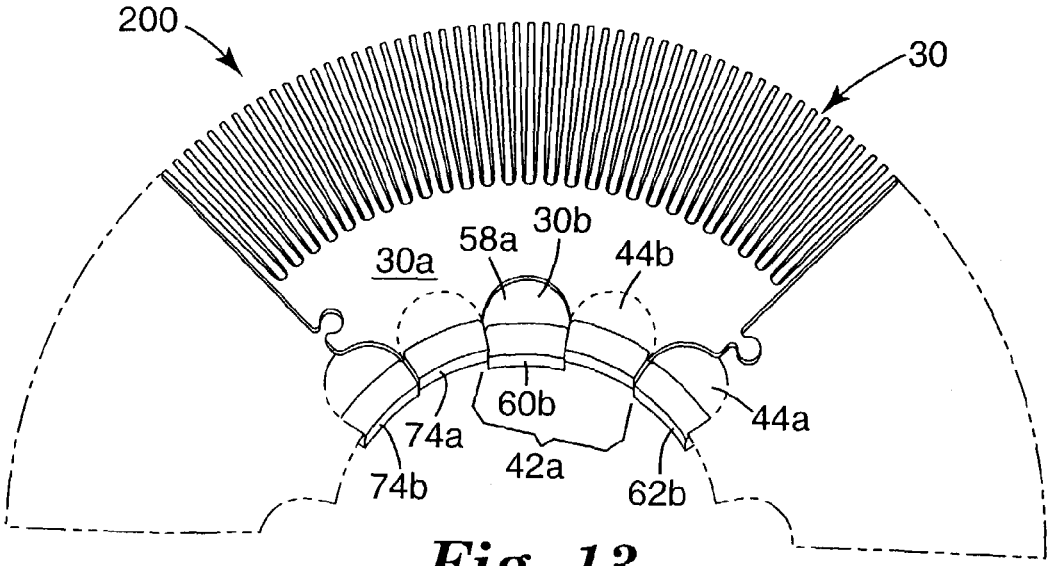
FIG. 13 is a partial view illustrating one exemplary embodiment of a brush assembly according to the present disclosure.
Figure 13A:
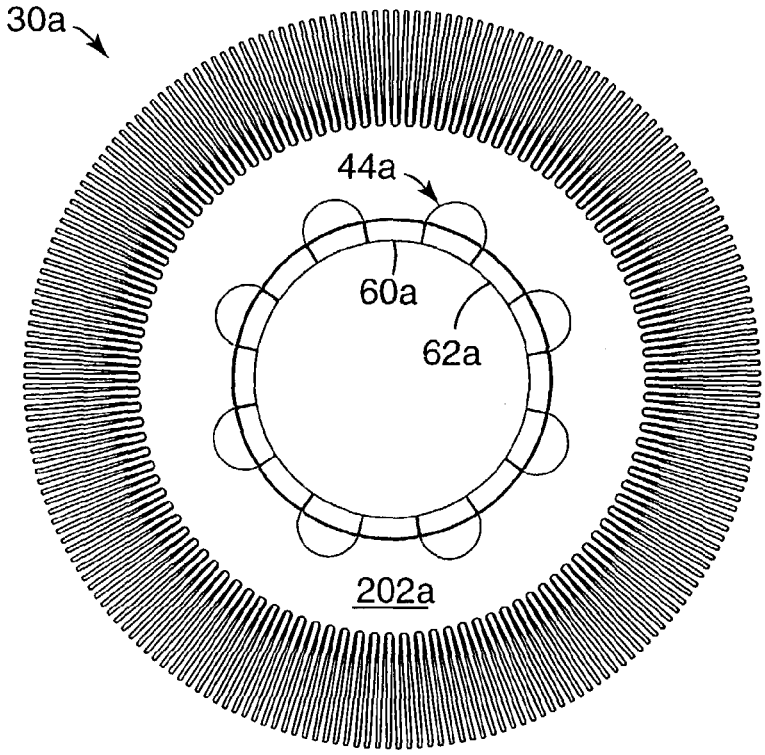
FIG. 13*a* is a plan view of an example embodiment of a brush assembly according to the present disclosure.
Figure 13B:
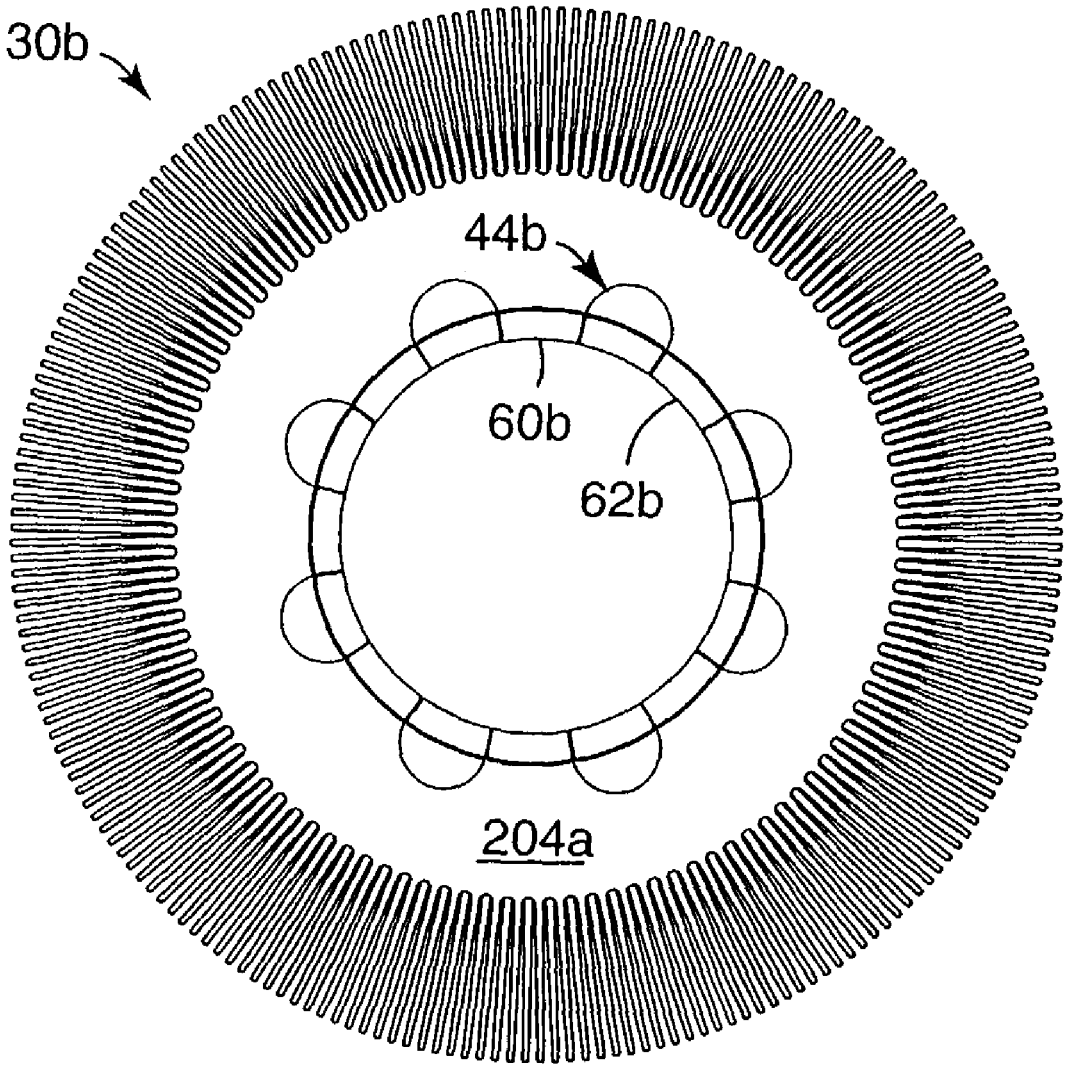
FIG. 13*b* is a plan view of an example embodiment of a brush assembly according to the present disclosure.
Figure 13C:
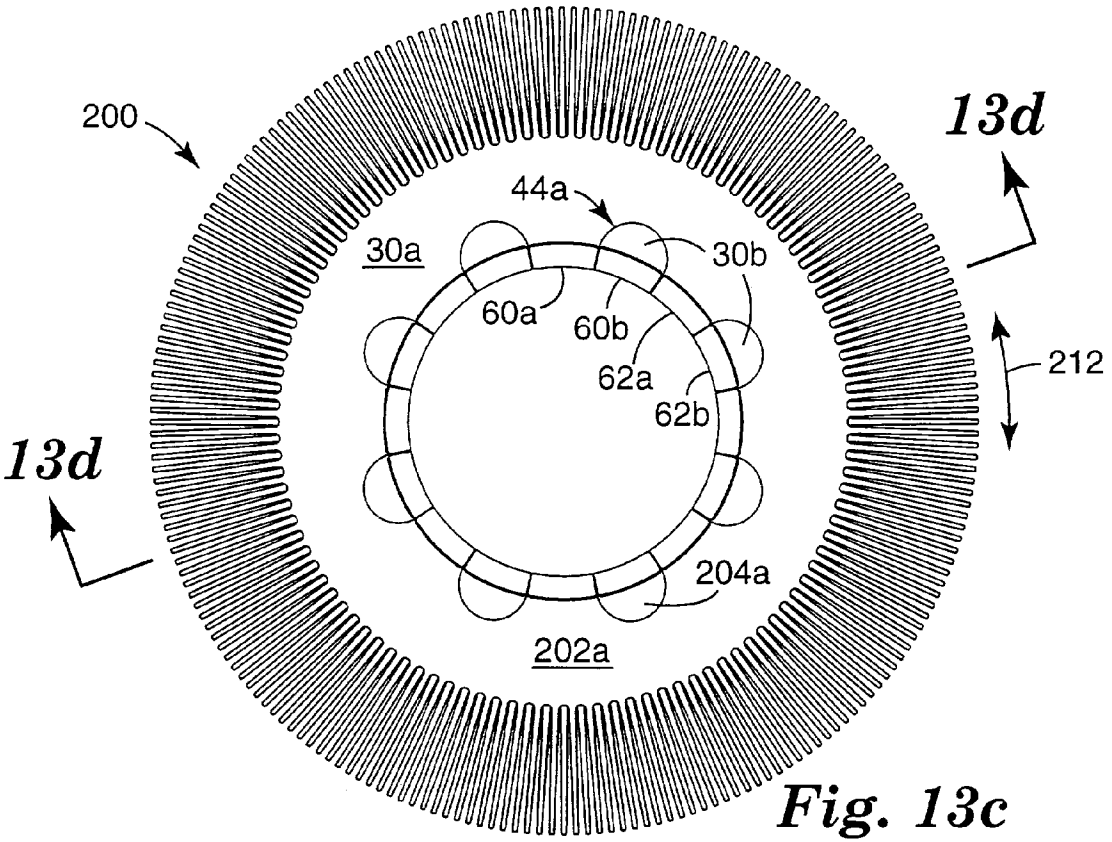
FIG. 13*c* is a plan view of an example embodiment of a brush assembly according to the present disclosure.

Referring to FIGS. 13*a*–*c*, two or more brush elements can be formed into a brush assembly 200. Brush assembly 200 is typically mounted on a rotating member (not shown) that rotates the brush assembly, which then engages a substrate or work surface to remove material or otherwise modify from the substrate or work surface. A hub assembly (not shown) of a rotary tool can also be operably coupled the interlock arrangement of the brush element, thus eliminating or reducing the need for a component to interlock a brush assembly with the rotary tool.

When the brush assembly is rotating, it is often desirable that the individual brush elements rotate uniformly, and relative rotation between brush elements can result in a sub-optimal finish on the substrate. The brush elements of the present disclosure include an interlock arrangement to eliminate relative rotation between adjacent brush elements. Referring to FIGS. 1, 2, 2*a*, 13, and 13*a*–13*d*, adjacent brush elements are kept from rotating relative to one another by an interlock arrangement 42. Each adjacent brush element includes a complementary interlock arrangement (e.g., includes at least one receiving area, such as receiving area 44, and one engaging member, such as receiving member 62) extending from the inner edge 34 into the segment center portion 32. In the exemplary embodiments shown, receiving area 44 is a regular geometrical shape, being partially circularly-shaped but can vary to any suitable shape. Other suitable shapes for receiving area 44 will become apparent to one skilled in the art after reading the present application.

Brush element 30 (FIG. 1) includes multiple receiving areas 44, 46, 48, 50, 52, 54, 56, 58 spaced about inner edge 34. Each receiving area 44, 46, 48, 50, 52, 54, 56, 58 receives and holds its corresponding engagement member 60, 62, 64, 66, 68 70, 72, 74. When multiple brush segments are used to form a brush element, a receiving area can be formed between two adjacent segments, such as receiving area 56. Receiving area 56 is formed between and extends into adjacent disk segments 80, 86. Similarly, receiving area 46 extends into and is formed between adjacent disk segments 80, 82.

Figure 2A:
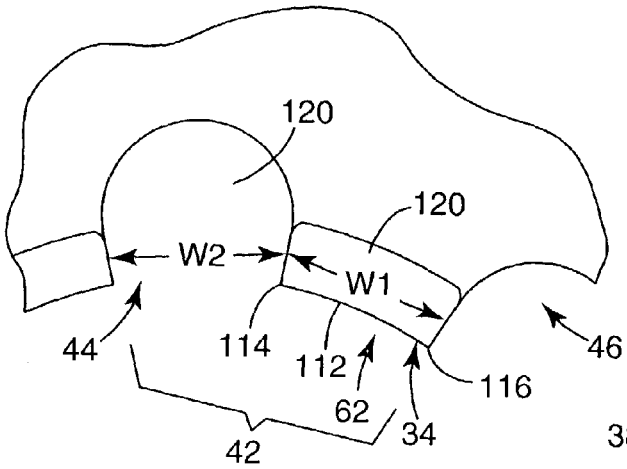
FIG. 2*a* is an enlarged plan view of the interlock arrangement of FIG. 2.

Referring to FIGS. 2 and 2*a*, an exemplary embodiment of an interlock arrangement is shown. Interlock arrangement 42 includes an engaging member 62 positioned along the inner edge 34. Engaging member 62 is located between receiving area 44 and receiving area 46. Engaging member 62 includes an inner edge 112, a first corner 114 and a second corner 116. In the example embodiment shown, first corner 114 and second corner 116 are generally right-angled corners, but can be other shapes, for example, a corner having a radius. Engaging member 62 has a first width (W1) and receiving area 44 has a second width (W2) along the inner edge 34. In the example embodiment shown, W1 and W2 are approximately equal in width, though one skilled in the art will recognize other suitable arrangements can be used. Referring to FIG. 1, brush element 30 includes eight regularly spaced interlock arrangements 42 with each receiving area and engaging member being of approximately equal width.

Referring to FIG. 13, a partial view of an exemplary embodiment of a brush assembly 200 is shown. Brush assembly 200 includes two adjacent brush elements 30*a*, 30*b*. Brush elements 30*a*, 30*b* are oriented such that interlock arrangement 42*a* of brush 30*a* cooperates with interlock arrangement 42*b* of brush element 30*b* to restraint relative rotation between the brush elements 30*a*, 30*b*. Engagement member 60*b* of brush element 30*b* is received into and held by receiving area 58*a* of brush element 30*a*. Engagement member 60*a* of brush element 30*a* is received into and held by receiving area 44*b* of brush element 30*b*. Similarly, when more than one interlock arrangement is on each adjacent brush element, an interlock arrangement on each brush element will cooperate with its corresponding interlock arrangement on the adjacent brush element to engage and keep the brush elements from rotating relative to one another.

Adjacent brush elements (for example 30*a* and 30*b*) element can further be secured together, using, for example, adhesives, fasteners, or other suitable means (known to those skilled in the art). In this manner, any number of brush elements 30 may be assembled together to provide a brush assembly 200 of a desired width.

Referring to FIG. 3, a cross-sectional view, taken along line 3—3 of FIG. 2, of a brush segment 80 is shown. Edge member 62 includes increased thickness portion 128 located at the inner edge 34. Increased thickness portion 128 has an increased thickness TI relative to a thickness T2 of center portion 32 at outer edge 36. It is desirable that the engagement member 62 is of sufficient strength to resist any shear forces generated between adjacent brush elements. Desirably, the increased thickness portion 128 is up to 50% more than the thickness of element center portion 92 near outer edge 36, though it can be more, depending on the particular interlock arrangements. Increased thickness portion 128 of edge member 62 extends into a corresponding receiving area of a second brush element and operates to interlock the brush element with the adjacent brush element when positioned adjacent the second brush element. Each corresponding interlock arrangement engages to interlock adjacent brush elements at each increased thickness portion 128 to restrain relative circumferential movement between brush elements.

Figure 4:
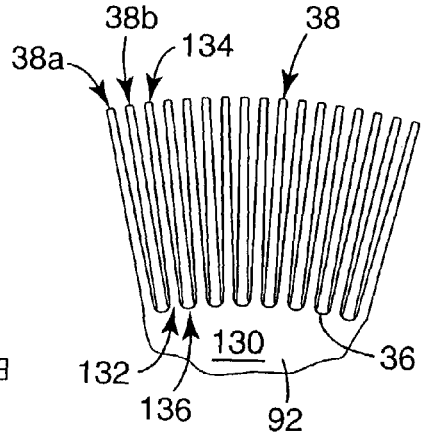
FIG. 4 is an enlarged view illustrating a portion of the bristles of the brush segment of FIG. 2.

Referring to FIG. 4, a portion of bristles 38 of the brush segment 80 (as shown in FIG. 2) is shown. Bristles 38 are integral with segment center portion 92. Bristles 38 extend radially outward from outer edge 36. In the example embodiment shown, bristles 38 include a first bristle row 38*a* spaced circumferentially about outer edge 36, and extending generally co-planar with surface 130 of segment center portion 92. Bristles 38 further include a second bristle row 38*b*, offset from first bristle row 38*a*. A second bristle row 38*b* extends radially outward from outer edge 36 and is spaced between the bristles located in bristle row 38*a*.

Alternatively, brush segment 82 may include a single row of bristles 38, or more than two rows of bristles 38. Each bristle 38 includes a bristle root 132 and a bristle tip 134. Each bristle 38 extends from outer edge 36 at the bristle root. In the exemplary embodiment shown, the area between adjacent bristle roots is generally rounded or filleted, indicated at 136. The generally rounded bristle root area provides increased strength at the location where each bristle 38 extends from outer edge 36 of segment center portion 92.

Figure 5:
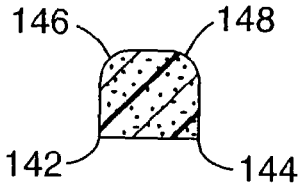
FIG. 5 is a cross-sectional view illustrating an exemplary embodiment of a bristle of a brush segment according to the present disclosure.
Figure 6:
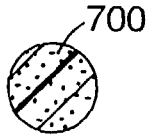
FIG. 6 is a cross-sectional view illustrating another exemplary embodiment of a bristle of a brush segment according to the present disclosure.
Figure 7:
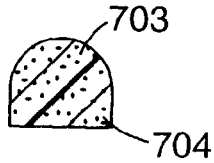
FIG. 7 is a cross-sectional view illustrating another exemplary embodiment of a bristle of the brush segment according to the present disclosure.
Figure 8:
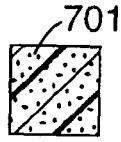
FIG. 8 is a cross-sectional view illustrating another exemplary embodiment of a bristle of the brush segment according to the present disclosure.

Referring to FIGS. 5–8, several example embodiments of bristle cross-sections that can be used with the brush elements according to the present disclosure are shown. Referring to FIG. 5, a one exemplary embodiment cross-sectional area is shown. Bristle 38 has a substantially rectangular cross-section, having a first square edge 142, a second square edge 144, a substantially rounded edge 146 and a substantially rounded edge 148. Bristles 38 may have other cross-sectional area shapes, including circular, star, half moon, quarter moon, oval, rectangular, square, triangular, diamond, or other polygonal shape or a combination of shapes. Other exemplary cross-section shapes are illustrated in FIGS. 6–8: FIG. 6 shows a bristle having a circular 700 cross-section; FIG. 7 shows a bristle having a cross-section including a semi-circular portion 703 and square portion 704; and FIG. 8 shows a bristle having a square 701 cross-section. Bristles can also have a constant cross-section along the length of bristle 38, but can also include a non-constant or variable cross-section along the length of the bristle.

Figure 9:
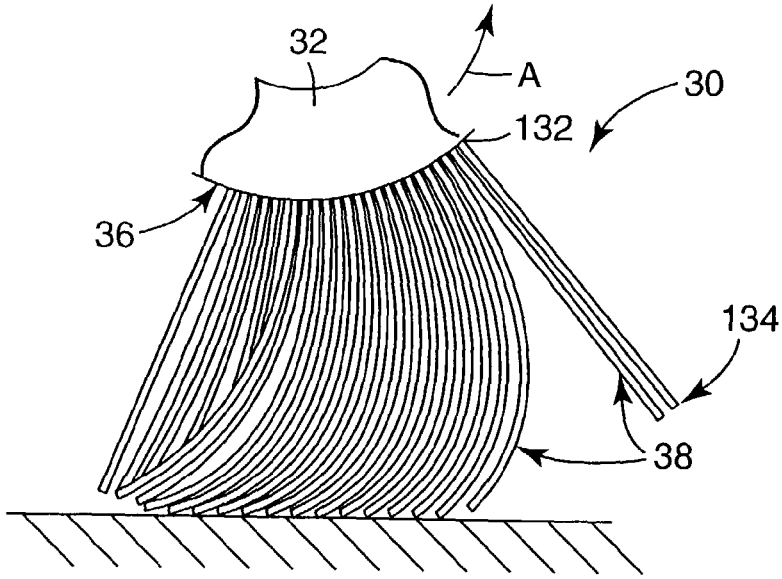
FIG. 9 is a partial elevation view of the brush element of FIG. 1 engaging a surface.

Bristles 38 may be tapered such that the cross-sectional area of the bristle decreases in the direction away from root 132 toward tip 134. Tapered bristles 38 can have any cross-section, such as those indicated above. Bristles 38 are subjected to bending stresses as brush segment 92 is rotated against a work piece, illustrated in FIG. 9. These bending stresses are highest at the root 132 of bristles 38 (at outer edge 36). A tapered bristle generally resists bending stresses more than a bristle of constant cross-sectional area. Bristles 38 can have a taper along the entire length, or can have a tapered portion adjacent the root 132 and a constant cross-sectional area for the remainder of the bristle 38. The taper can be of any suitable angle. Furthermore, brush segment 80 can include a fillet radius at the transition between root 132 of bristle 38 and outer edge 36 of segment center portion 92. The particular bristle design is within the knowledge of one skilled in the art.

Bristles 38 have an aspect ratio defined as the length of bristle 38 measured from outer root 132 to tip 134, divided by the width of the bristle. In the case of a tapered bristle, the width is defined as the average width along the length for purposes of determining the aspect ratio. In the case of non-circular cross-section, the width is taken as the longest width in a given plane, such as the corner-to-corner diagonal of a square cross section. The aspect ratio of bristles 38 is desirably at least two, but can be smaller (in some embodiments, about five to one-hundred, or, for example, from about 50 to 75). The size of bristles 38 can be selected for the particular application of brush segment 80 and brush element 30. The width of bristles 38 can be the same as or different from the thickness of center portion 92. In one exemplary embodiment, all of the bristles 38 have the same dimensions. Alternatively, bristles 38 on a brush element 30 comprising a plurality of brush segments 80, 82, 84, 86 may have different dimensions such as different lengths, widths, or cross-sectional areas. For example, a brush segment may have groups of short bristles and groups of long bristles. Further, it is possible to arrange brush segments to form a brush element, each brush segment having bristles of different length. Further, it is possible to employ adjacent brush segments having different bristles.

The density and arrangement of bristles 38 can be chosen for the particular application in brush segment 80 and brush element 30 is used. Bristles 38 are typically arranged uniformly spaced around the perimeter or outer edge 36 of center portion 32. Alternatively, bristles 38 can be arranged in groups with spaces between the groups, and can also be oriented in the plane of center portion 32 other than radially outward, that is, at a non-zero angle relative to the radius of center portion 32. Accordingly, brush segment 80 may have a portion of outer edge 36 that does not include any bristles 38. The bristles may be present over only a portion of outer edge 36 of center portion 32. Bristles 38 may or may not abut adjacent bristles as desired.

The material, length, and configuration of the bristles can be chosen such that bristles 38 are sufficiently flexible to aid in refining uneven or irregular work pieces. In some embodiments, the bristles 38 are capable of bending at least 25 degrees, (in some embodiments, at least 45 degrees, at least 90 degrees, or even about 180 degrees), without damage or substantial permanent deformation to the bristles.

It is possible to reinforce the bristles 38 with a suitable structure. For example, it is possible to place a reinforcing fiber or wire in the bristle mold cavities, and inject the moldable polymer around the reinforcing wire, resulting in a bristle 38 having a reinforcing wire or fiber embedded within it.

Figure 10:
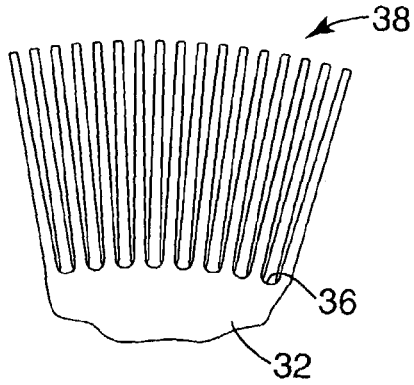
FIG. 10 is a partial view illustrating one exemplary embodiment of a molded brush segment according to the present disclosure in which the bristles extend outward relative to a radius of the brush segment.
Figure 11:
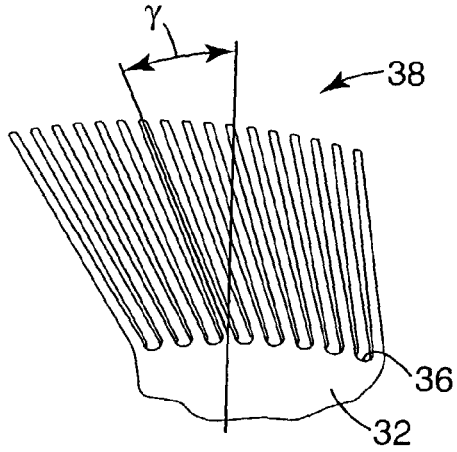
FIG. 11 is a view illustrating another exemplary embodiment of a brush segment according to the present disclosure in which the bristles are at an angle relative to a radius of the brush segment.
Figure 12:
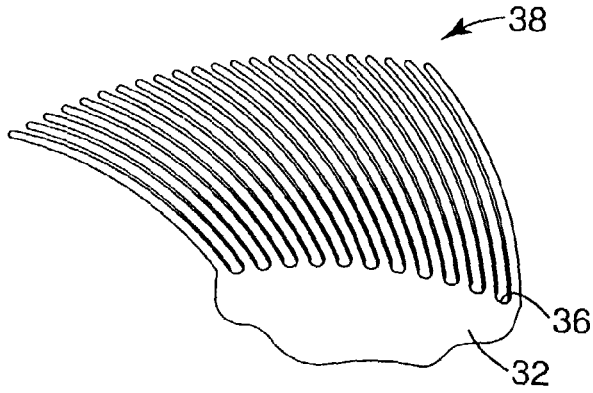
FIG. 12 is a view illustrating another exemplary embodiment of a brush segment according to the present disclosure in which the bristles extending from a center portion of the brush segment are curved.

FIGS. 10–12 illustrate exemplary embodiments of bristles 38 in varying orientations relative to center portion 32. In FIG. 10, bristles 38 extend substantially radially outward from outer edge 36 of center portion 32. In FIG. 11, bristles 38 extend outward, at an angle $\gamma$ relative to outer edge 36 of center portion 32. In FIG. 12, bristles 38 are curved, extending radially outward from outer edge 36 of center portion 32. Other suitable bristle configurations for use with a brush segment according to the present disclosure will become apparent to one skilled in the art after reading the present application.

Figure 13D:
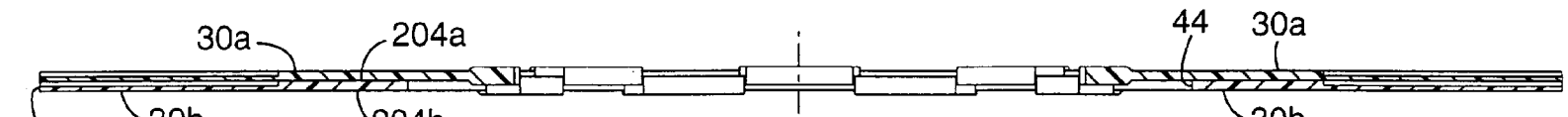
FIG. 13*d* is a section view of the brush assembly of FIG. 13*c*.

FIGS. 13*a*–13*b* illustrate one exemplary embodiment of positioning brush element 30*a* and brush 30*b* together to form brush assembly 200. FIG. 13*a* illustrates brush element 30*a*, brush element 30*a* includes a first major surface 202*a* and a second major surface 202*b* (not shown). FIG. 13*b* illustrates brush element 30*b*. Brush element 30*b* includes a first major surface 204*a* and a second major surface 204*b* (not shown). FIG. 13*c* illustrates one embodiment of brush assembly 200 comprising brush element 30*a* and brush element 30*b*. In some embodiments, brush element 30*b* edge members (e.g., edge member 60*b*) are positioned within the receiving areas of brush element 30*a* (e.g., edge member 60*b* is positioned within receiving area 44*a*). Reference is also made to FIG. 13*d*. First major surface 204*a* of brush element 30*b* is positioned against second major surface 202*b* of brush element 30*a*. Brush element 30*a* and brush element 30*b* are secured together, (e.g., using an adhesive). The positioning of brush element 30*b* edge members within the receiving areas of brush element 30*a* (or interlocking) eliminates movement (e.g., circumferential movement) between brush element 30*a* and brush element 30*b*, indicated by directional arrow 212.

Many different bristle patterns can be achieved as desired by varying the orientation of the brush elements relative to each other within a brush assembly. Four different brush patterns are possible using the example embodiment brush segment shown in FIGS. 1 and 2. FIGS. 14, 15, 16 and 17 illustrate the four different bristle patterns that can be made using the brush segment of FIG. 2. Interlock arrangement 42 repeats around the inner edge 32 at 45-degree intervals, which is two times angle α (FIG. 2). Angle α is 22.5 degrees and illustrates the symmetry of the interlock arrangement 42 about radii R1 and R2. Radius R1 is from the center point P of the brush segment through the centerline of a receiving area 44. Radius R2 is from the center point P through the centerline of the engagement member 60. Bristles on the segment 80 are arranged so that there are two rows of alternating bristles. In the example embodiment shown, each row has one-hundred eight bristles when four brush segments are formed into a brush element, so that each brush element has two-hundred sixteen bristles regularly spaced around the circumference of the brush element. After reading this specification, one of skill in the art will appreciate that other bristle patterns are possible that allow a single segment to form multiple bristle patterns or arrangements. Differing bristle patterns can provide differing finishing characteristics on a work piece or work surface. Additionally, differing bristle patterns may provide differing effects on a work surface or substrate.

Figure 14:
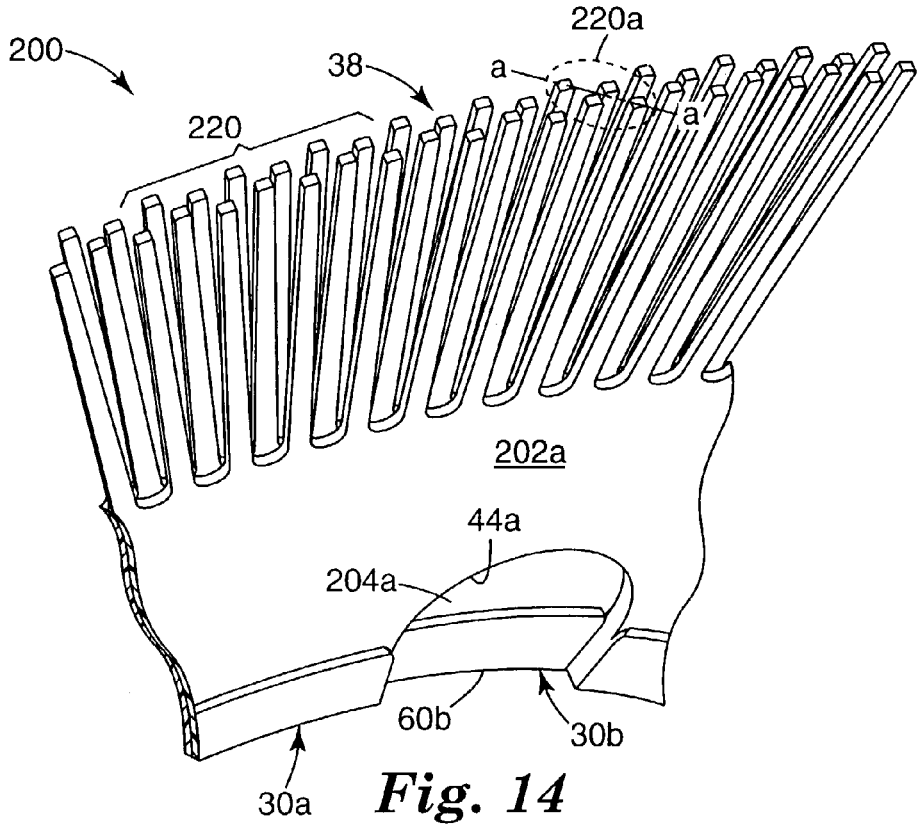
FIG. 14 is a partial diagram illustrating one exemplary embodiment of a bristle pattern in a brush assembly according to the present disclosure.

Referring to FIG. 14, a partial diagram illustrating a first exemplary embodiment of an alternating bristle pattern 220 is shown. Alternating bristle pattern 220 is achieved by positioning brush element 30*b* first major surface 204*a* against the brush element 30*a* second major surface 202*b*. The first bristle pattern is achieved by first placing two adjacent brush elements such that they are in-line with respect to their respective interlock arrangements. For example, referring to FIGS. 1, 2, and 13, a second brush element 30*a* would be placed on a first brush element 30*b* so that the their respective engagement members 44*b*, 60*b* were coincidentally aligned. Bristle pattern 220 is created by rotating the first brush element 30*b* 22.5 degrees in a clockwise direction to engage engaging member 60*b* with receiving area 58*a*. The same pattern could also be achieved by rotating the first brush element 30*b* 67.5 (angle β) degrees in a counter-clockwise direction. Bristles of the first brush element 30*b* are interleaved and over lap with bristles of the second brush element 30*a* in a plane taken radially between the center portions of each brush element.

Figure 15:
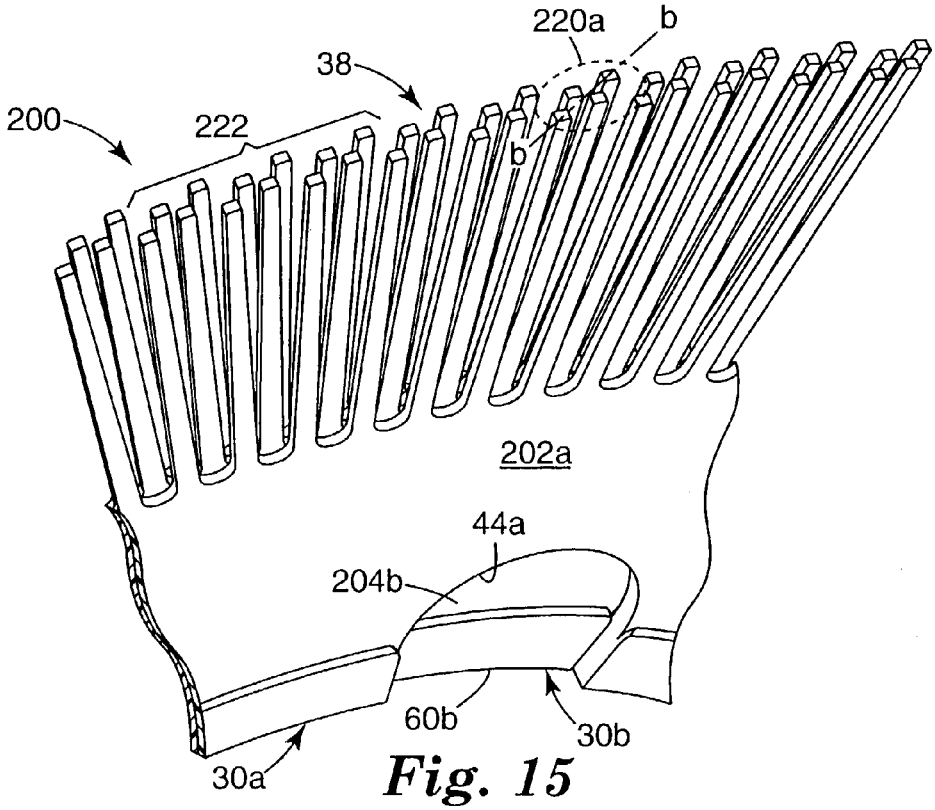
FIG. 15 is a diagram illustrating another exemplary embodiment of a bristle pattern in a brush assembly according to the present disclosure.

Referring to FIG. 15, a second alternating bristle pattern 222 is shown. From the same starting point, second bristle pattern 222 is achieved by rotating the first brush element 30*b* 22.5 degrees in a counter-clockwise direction or 67.5 degrees in a clockwise direction from the alignment used to make the first bristle pattern 220. In this pattern, bristles of the first brush element 30*b* are interleaved and over lap with bristles of the second brush element 30*a* in a plane taken radially between the center portions of each brush element, but have a bias or relative orientation offset from the first pattern by about 90 degrees (i.e., line a—a, taken along the long axis of the first pattern 220*a* is about 90 degrees offset from line b—b, taken along the long axis of pattern 220*b*).

Figure 16:
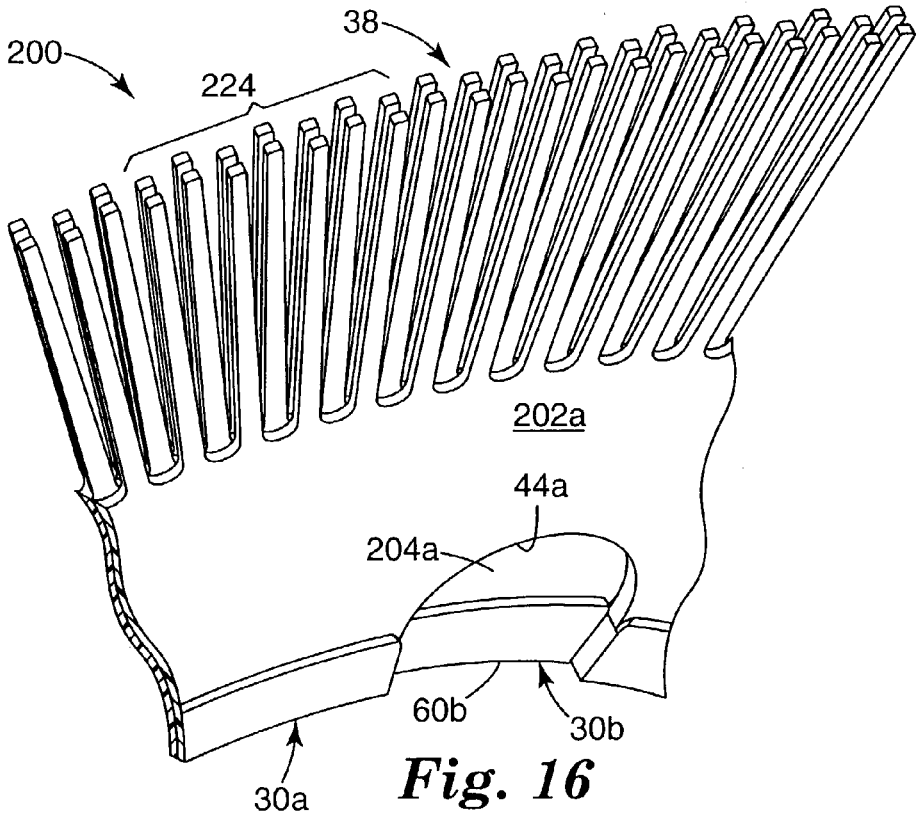
FIG. 16 is a diagram illustrating another exemplary embodiment of a bristle pattern in a brush assembly according to the present disclosure.

Referring to FIG. 16, a third bristle pattern is shown. Third bristle pattern 224 is creating by beginning with the first and second brush elements 30*a*, 30*b* coincident, as was done to create the first pattern 220. Before any rotation of the adjacent elements is done, first brush element 30*b* is rotated or flipped about its radial centerline (line R2 in FIG. 2). Bristle pattern 224 is created by rotating the flipped first brush element 30*b* 22.5 degrees in a clockwise direction to engage the interlock arrangement. The same pattern could also be achieved by rotating first brush element 30*b* 67.5 degrees in a counter-clockwise direction. Bristles of the first brush element 30*b* are in-line with bristles of the second brush element 30*a*, as viewed along the center axis (through point P in FIG. 2) of each element. In this bristle pattern 224, the distance between alternating pairs of adjacent bristles is varied.

Figure 17:
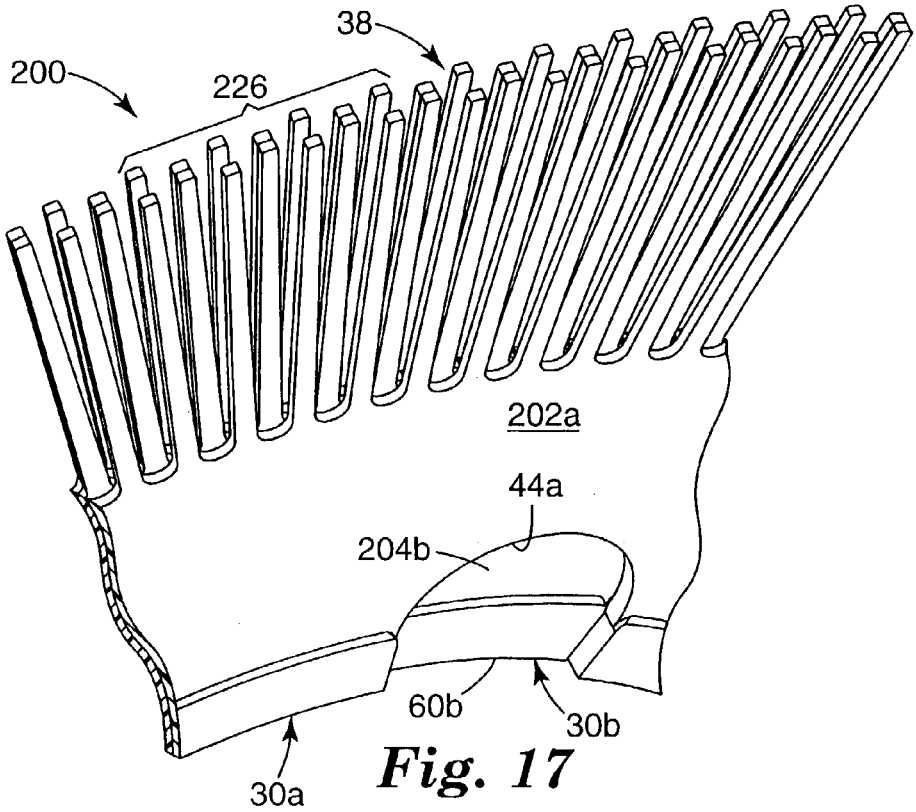
FIG. 17 is a diagram illustrating another exemplary embodiment of a bristle pattern in a brush assembly according to the present disclosure.

Referring to FIG. 17, a second inline pattern 226 is created by further rotating first brush element 30*b* 22.5 degrees in a counter-clockwise direction or 67.5 in a clockwise direction. In this bristle pattern 226, the distance between alternating pairs of adjacent bristles is generally constant.

If the interleaving patterns 220, 222 only are desired, the brush elements can include the raised portions and receiving cavities for assisting alignment and preventing relative rotation between elements (as previously described). By using the above-described patterns, a brush assembly can be made to include one or more of the patterns described. Also, multiple patterns can be used in a single brush assembly. One of skill in the art will appreciate that other repeating bristle patterns can be made by creating symmetry between the interlock arrangement spacing and the bristle pattern on an individual brush element.

The brush element and brush segments of the present disclosure can be made using various techniques known in the art, for example, injection molding, stamping, die cutting, sterolithography, or casting. When making brushes or brush segments according to the present disclosure using injection molding, typically, a moldable polymeric material, for example, thermoplastic polymers, thermosetting polymers, or thermoplastic elastomers, is used. Suitable materials for making injection molded abrasive brushes are known to one of skill in the art and their selection will depend on the application for which a brush segment or brush assembly will be used. One particular material that can be used in the brush segments and brush elements is a commercially available segmented polyester, including those marketed under the trade designations "HYTREL 4056", "HYTREL 5526", "HYTREL 5556", "HYTREL 6356", "HYTREL 7246", and "HYTREL 8238" by E.I.Du Pont de Nemours and Company, Inc., Wilmington, Del. A similar family of thermoplastic polyesters is marketed under the trade designation "RITEFLEX" by Hoechst Celanese Corporation. Examples of suitable thermoplastic elastomers are described, for example, in U.S. Pat. No. 542,595 (Pihl et al.), the entire disclosure of which is incorporated herein by reference The brush elements and brush segments can also include abrasive particles. The abrasive particles can be on the surface of the abrading surface or member (e.g., bristles), dispersed throughout, or a combination thereof. Including abrasive particles throughout the bristles will allow the abrasive qualities of the bristles to remain relatively constant during use, even when the bristles wear and are reduced in size by use. Abrasive particles are known to those skilled in the art and the selection and incorporation of abrasive particles in the brush elements and segments will depend on a variety of factors, including the nature of the work surface and other operating conditions. The selection of a particular abrasive particle or particles is within the knowledge of one skilled in the art. Examples of abrasive particles include fused aluminum oxide, heat treated fused aluminum oxide, ceramic aluminum oxide, heat treated aluminum oxide, silicon carbide, titanium diboride, alumina zirconia, diamond, boron carbide, ceria, aluminum silicates, cubic boron nitride, garnet, silica, and combinations thereof. Fused aluminum oxides are commercially available, for example, from Exolon ESK Company, Tonawanda, N.Y., and Washington Mills Electro Minerals Corp., North Grafton, Mass. Suitable ceramic aluminum oxide abrasive particles include those described in U.S. Pat. No. 4,314,827 (Leitheiser et al.); U.S. Pat. No. 4,744,802 (Schwabel); U.S. Pat. No. 4,770,671 (Monroe et al.); 4,881,951 (Monroe et al.); U.S. Pat. No. 4,964,883 (Morris et al.); U.S. Pat. No. 5,011,508 (Wald et al.); and U.S. Pat. No. 5,164,348 (Wood), the entire contents of all of which are incorporated herein by reference. Suitable alpha alumina-based ceramic abrasive particles comprising alpha alumina and rare earth oxide include those marketed under the designation "CUBITRON 321" by The 3M Company, St. Paul, Minn. Other examples of particles useful for this disclosure include solid glass spheres, hollow glass spheres, calcium carbonate, polymeric bubbles, silicates, aluminum trihydirate, and mullite. The abrasive particle can be any particulate material (inorganic or organic) that when combined with the binder results in a brush element that can refine a workpiece surface. The selection of the abrasive material will depend in part on the intended application. For example, for stripping paints from a vehicle, it is sometimes desirable to omit abrasive particles from the brush element. It is sometimes desirable to use a relatively soft abrasive particle when stripping paints so as not to damage the surface underneath the paint. Alternatively, for removing burrs from metal workpieces, it is typically desirable to use a harder abrasive particle such as those made of alpha alumina. The brush element of the present disclosure may include two or more types and/or sizes of abrasive particles in those embodiments that include the optional abrasive particles.

As used herein, the term abrasive particle also encompasses single abrasive particles that are bonded together to form an abrasive agglomerate. In some instances, the addition of the coating improves the abrading and/or processing characteristics of the abrasive particle. Examples of abrasive agglomerates are found in, for example, U.S. Pat. No. 5,011,508 (Wald et al.), which is herein incorporated by reference.

Organic abrasive particles suitable for use with the brush element of the present disclosure include those formed from a thermoplastic polymer and/or a thermosetting polymer. Organic abrasive particles useful in the present disclosure may be individual particles or agglomerates of individual particles. The agglomerates may comprise a plurality of the organic abrasive particles bonded together by a binder to form a shaped mass.

The polymeric material used to make brush elements and brush segments of the present disclosure may further include a grinding aid. A grinding aid is a particulate material that the addition of which has a significant effect on the chemical and physical processes of abrading, resulting in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite and metallic sulfides.

Figure 18:
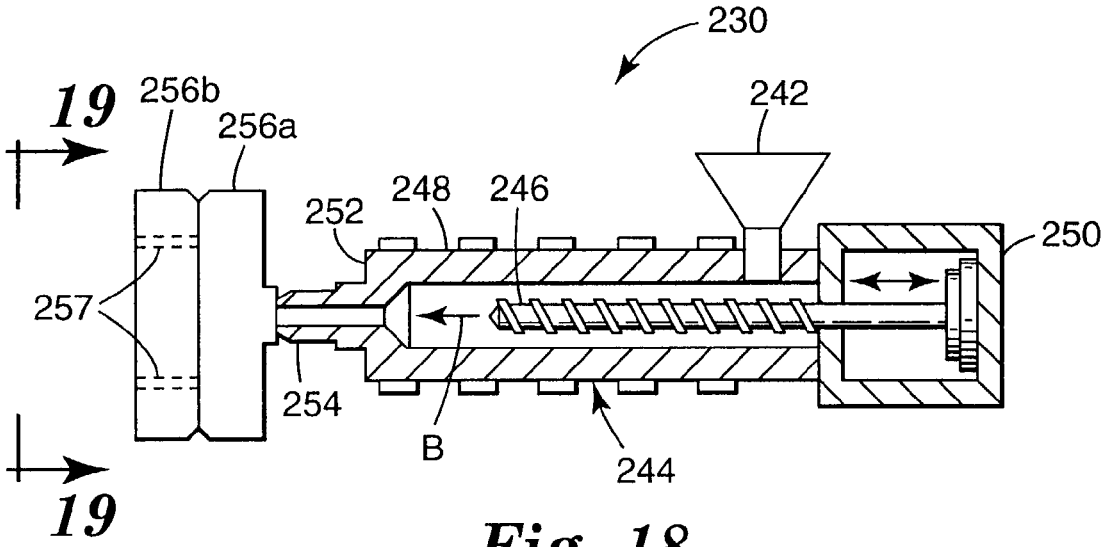
FIG. 18 is a schematic illustration of an exemplary mold apparatus that can be used in a method for carrying out the present disclosure.
Figure 19:
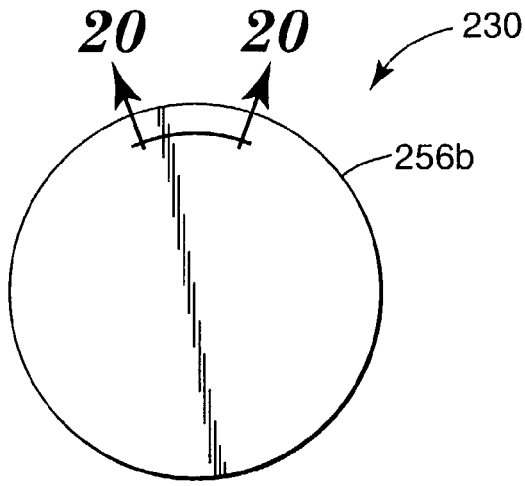
FIG. 19 is an elevational view of the mold of FIG. 18.

The brush element or brush segments of the present disclosure can be made, for example by injection molding. Injection molding techniques are known in the art. An exemplary injection molding apparatus 230 for making brush segment according to the method of the present disclosure is illustrated in FIG. 18. Typically, after being dried by heating, a mixture of pellets comprising moldable polymer and, optionally, abrasive particles is placed in a hopper 242. The hopper 242 feeds the mixture into a first or rear side 250 of a screw injector 244 generally comprising a screw 246 within a barrel 248. The opposite side, or front side 252 of screw injector 244 includes nozzle 254 for passing the softened mixture into mold 256*a*, 256*b*. Barrel 248 of injector 244 is heated to melt the mixture, and rotating screw 66 propels the mixture in the direction of nozzle 254. Screw 246 is then moved linearly frontward in direction B to impart the "shot" of the softened mixture into mold 256*a*, 256*b* at the desired pressure. A gap is generally maintained between the forward end of the screw and the nozzle to provide a "cushion" area of softened material that is not injected into the mold.

Figure 20:
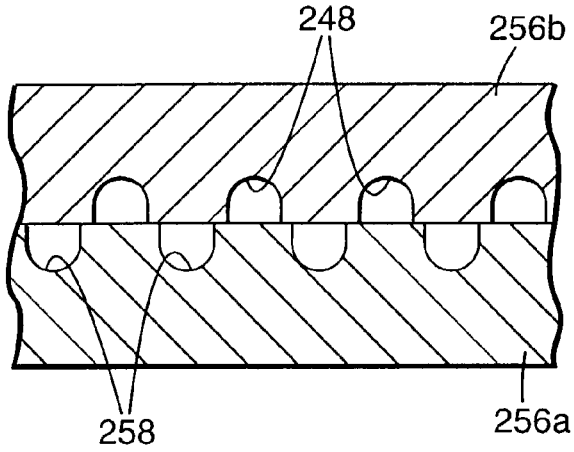
FIG. 20 is a sectional view of an exemplary embodiment of the mold portions of FIG. 18, taken along line 20—20 of FIG. 19.
Figure 21:
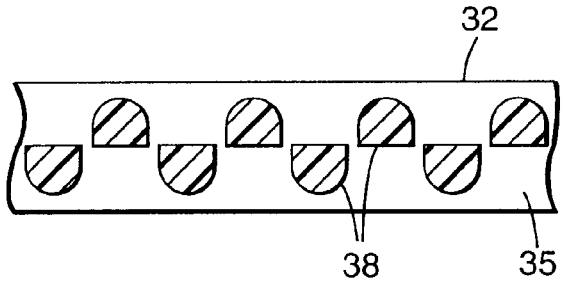
FIG. 21 is a view illustrating an exemplary embodiment of the mold portions of FIG. 19.
Figure 22:
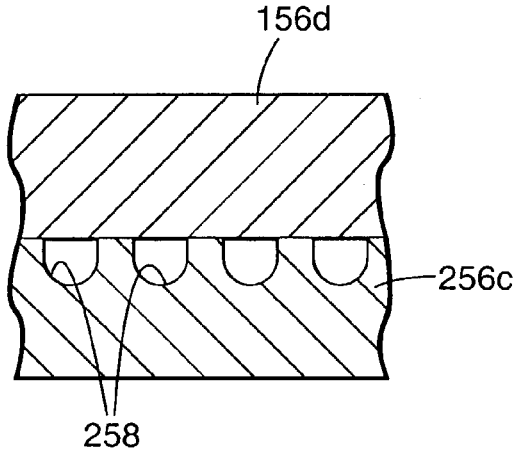
FIG. 22 is a sectional view illustrating an another exemplary embodiment of the brush segment made by the mold of FIG. 20.

The mold 256*a*, 256*b* contains cavities that are the inverse of the desired brush segment configuration. Thus, the mold design takes into account the brush segment configuration including the size and configuration of center portion 32, bristles 38, and optional attachment means such as holes, roots, keyways, or a threaded stud. As seen in FIG. 20, mold portion 256*a* includes cavities 258 for forming bristles. The exemplary mold embodiment illustrated in FIG. 20 is configured to mold a double row of staggered bristles. Such a bristle arrangement is illustrated in FIG. 21. Alternatively, for example, mold portions 256*c* and 256*d* illustrated in FIG. 22 can be used to form a single row of bristles 18, or a combination of the desirable single row configuration.

The above-mentioned pellets can be prepared, for example, as follows. Moldable polymer is heated above its melting point and optional abrasive particles, if desired, can then be mixed in. The resulting mixture is then formed into continuous strands and the strands are cooled to solidify the moldable polymer for pelletizing on suitable equipment as is known in the art. Likewise, lubricants and/or other additives to the polymeric material can be included in the formation of the pellets. The pellets comprising moldable polymer, abrasive particles, and any desired lubricant or other additive are then placed into hopper 242 to be fed into screw extruder 244 as described above.

The conditions under which the brush segment is injection molded are determined, for example, by the injection molder employed, the configuration of brush segment, and the composition of moldable polymer and abrasive particles. In one exemplary method, moldable polymer is first heated to in a range from 70° C. to 120° C., (in some embodiments, in a range from 80° C. to 100° C.) for drying, and is placed in hopper 242 to be gravity fed into the screw feed zone. The barrel temperature of the screw injector is desirably from about 200° C. to 250° C., and more desirably from about 220° C. to 245° C. The temperature of the mold is desirably from about 50° C. to 150° C., and more desirably from about 100° C. to 140° C. The cycle time (the time from introducing the mixture into the screw extruder to opening the mold to remove the molded brush segment) will desirably range between 0.5 to 180 seconds, more desirably from about 5 to 60 seconds. The injection pressure will desirably range from about 690 to 6,900 kPa (100 to 1000 psi), more desirably from about 2070 to 4830 kPa (300 to 700 psi). The choice of the particular operating conditions for injection molding is within the knowledge of one skilled in the art, and can vary outside of the example ranges given, depending on the particular application.

The injection mold cycle will depend upon the material composition and the brush segment configuration. In one example embodiment for making a brush segment, the moldable polymer and abrasive particles are generally uniformly dispersed throughout brush segment 80. In such an embodiment, there will be a single insertion or shot of mixture of the polymeric material and abrasive particle to mold brush segment, including center portion, bristles, and the attachment means, if present. Alternatively, bristles may contain abrasive particles, but center portion does not. In such an embodiment, there will be two insertions or shots of material. The first insertion will contain a mixture of moldable polymer and abrasive particles to primarily fill the bristle portion of the mold. The second insertion will contain moldable polymer (which may be the same or different from the moldable polymer of the first insertion) without abrasive particles to primarily fill the center portion and root portions of the mold. Likewise, center portion and bristles may contain abrasive particles, while root may not contain abrasive particles. In this construction there will be two insertions or shot of material. The first insertion will contain a mixture of moldable polymer and abrasive particles to fill the bristle and center portion portions of the mold. The second insertion will contain only a moldable polymer (which may be the same or different from the moldable polymer of the first insertion) to primarily fill the attachment means portion of the mold. It is also possible to use more than one shot to vary the color, if desired, of different portions of the brush segment. It is also possible to employ three or more shots, for example one each for the bristles, center portion, and attachment means. After injection molding, the mold is cooled to solidify the moldable polymer. The mold halves are then separated to allow removal of molded brush segment.

Figure 23:
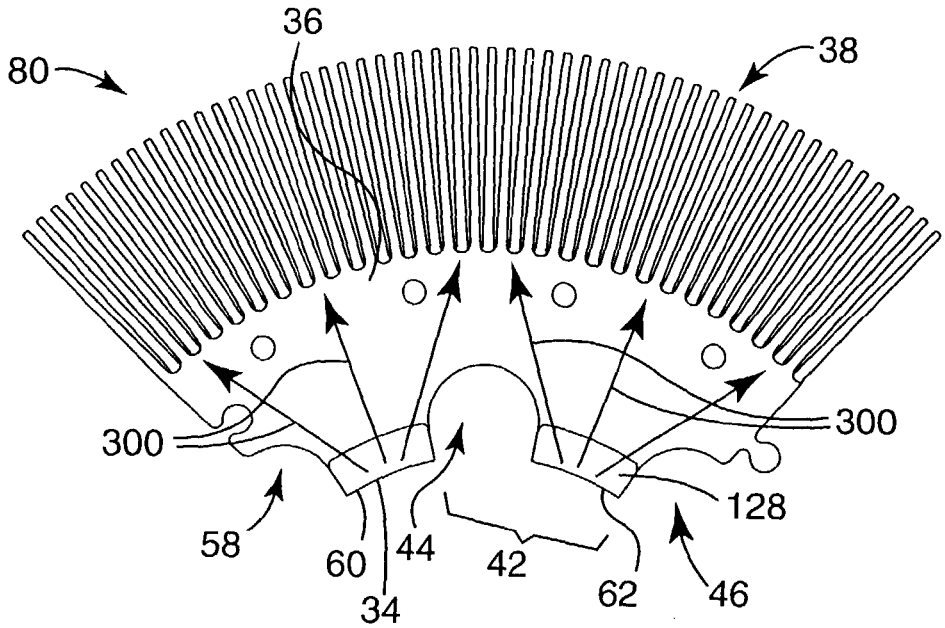
FIG. 23 is a partial view illustrating an exemplary disk segment, including mold flow lines illustrating the flow of material in making a brush segment according to the present disclosure.

Referring to FIG. 23, a diagram illustrating one embodiment of mold flow during molding of a molded brush segment (e.g., molded brush segment 80) is shown. Interlock arrangement 42 operates as a mold gate interface located at inner edge 34, configured to improve mold flow from the inner edge 34 to outer edge 36 during molding of the brush segment 80. Mold flow lines are illustrated at 300. During molding of brush segment 80, it is desirable to have mold flow lines of substantially equal length resulting in uniform mold flow to outer edge 36. Edge members 60, 62 interlock directly with a mold gate. Receiving areas 58, 56, and 46 operate to direct mold flow, resulting in more uniform mold flow to outer edge 36. Further, the increased thickness portion 128 immediately adjacent a mold gate results in further uniformity of mold flow to outer edge 36. Molded brush segment 80 requires less material for molding due to the presence of receiving areas 58, 44 and 46.

Figure 24:
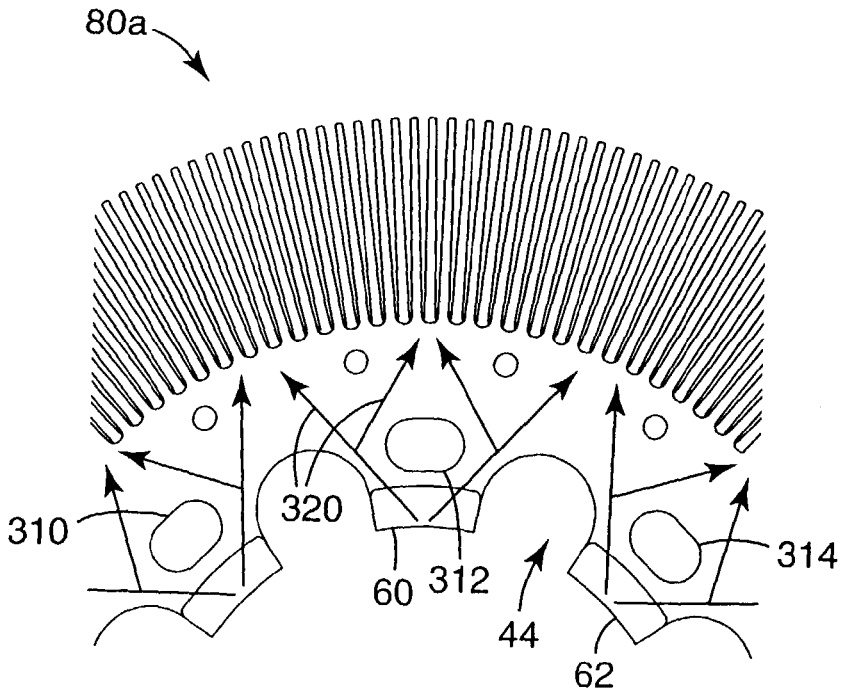
FIG. 24 is a partial diagram illustrating another exemplary embodiment of a brush segment according to the present disclosure, showing the direction of mold flow during molding of the brush segment.

Referring to FIG. 24, a example embodiment of molded brush segment 80 for optimizing mold flow during molding of the molded brush segment is shown. Molded brush segment 80*a* additionally include openings 310, 312, 314. Openings 310, 312, 314 provide further optimization of mold flow during molding of molded brush segment 80. Openings 310, 312, 314 provide for further directing of mold flow, indicated by flow vectors 320.

Figure 25:
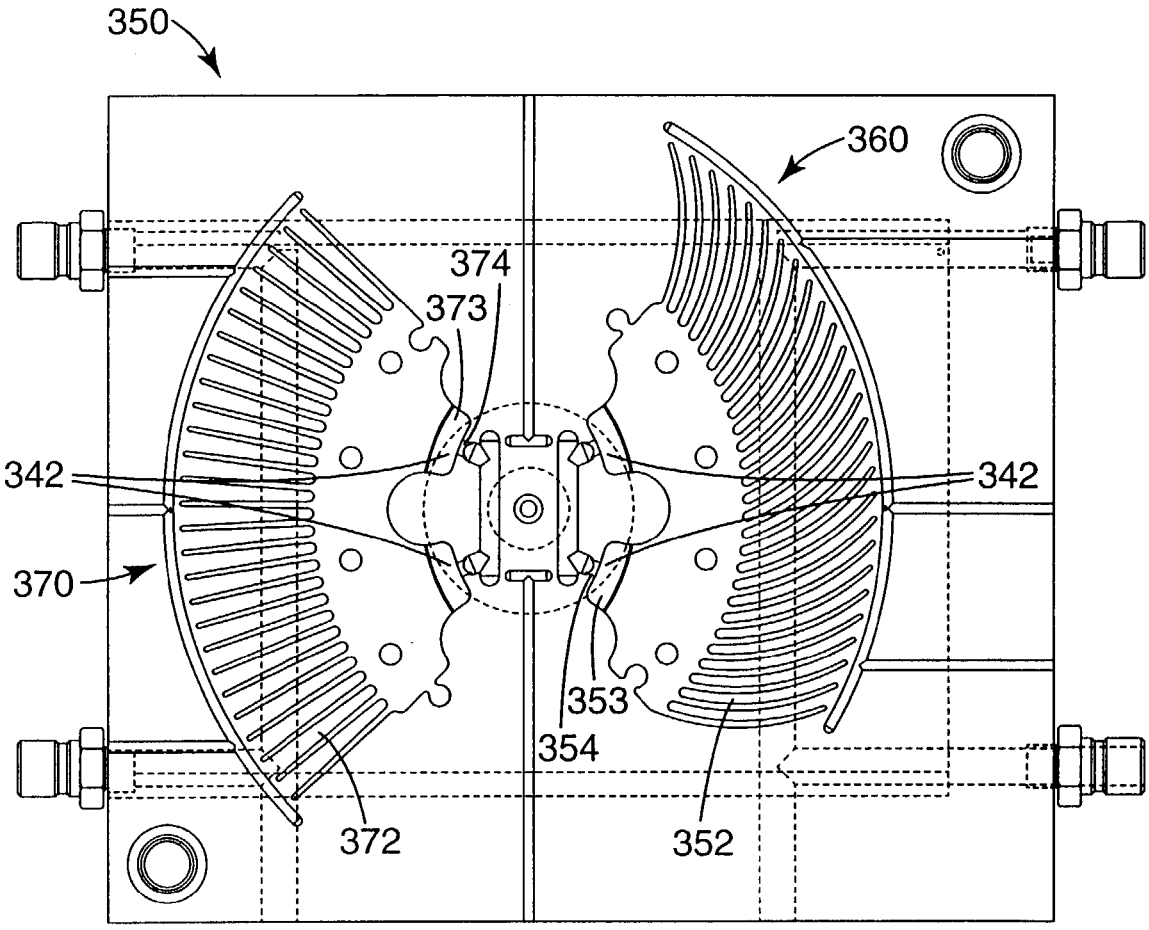
FIG. 25 is a plan view of an example embodiment of a mold that can be used to make brush segments of the present disclosure.

Referring to FIG. 25, an example embodiment of a mold 350 for making brush segments of the present disclosure is shown. Two different brush segments 360, 370 are made on mold 350. Brush segment 360 includes curved bristles 352. Brush segment 370 includes straight bristles. Typically, each brush segment has an 8-inch (203.2 mm) diameter, although other sizes can be made according to the present disclosure. Each engagement member 354, 374 interfaces with a respective mold gate 353, 373. By locating the mold gate at the increased thickness portion of the engaging members 354, 374, mold flow into the mold is improved, as previously described. While the example embodiment mold shown makes brush segments, the mold could also be designed to make other combinations, for example, a single brush element, or more or less similar or different brush segments.

Figure 26A:
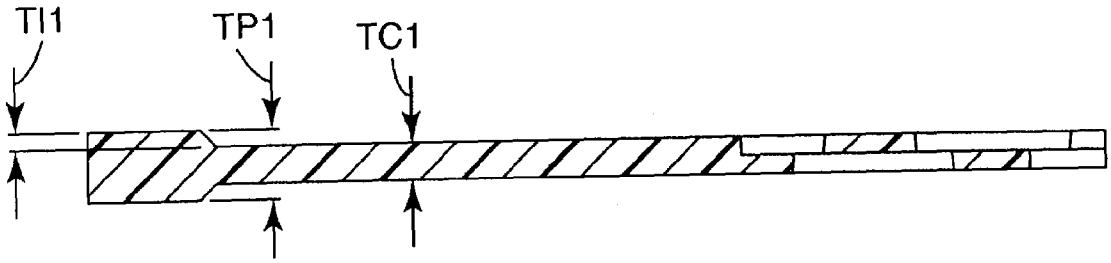
FIGS. 26*a*–*b* are section views of example embodiments of brush elements.
Figure 26B:
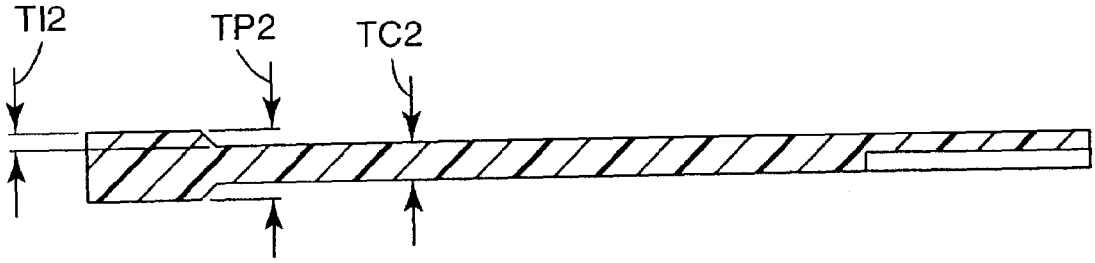

Referring now to FIGS. 26*a*–*b*, shown are cross-sectional views of example embodiments for brush elements for an 8-inch (203.2 mm) diameter brush, similar to the view of FIG. 3. Referring to FIG. 26*a*, shown is a brush element having curved bristles including a center portion thickness TC1 of about 0.050 inches (1.27 mm). Increased thickness portion TP1 (at the interlock arrangement engaging member) is about 0.094 inches (2.39 mm) with an increased thickness TI1 of about 0.022 inches (0.559 mm) on each side of the engaging member. In another example embodiment, the brush element of FIG. 26*a* could be made thicker, including a center portion thickness TC1 of about 0.062 inches (1.57 mm), with the increased thickness portion TP1 (at the interlock arrangement engaging member) about 0.120 inches (3.05 mm) and with an increased thickness TI1 of about 0.016 inches (0.406 mm) on each side of the engaging member. Referring to FIG. 26*b*, shown is a brush element having straight bristles including a center portion thickness TC2 of about 0.050 inches (1.27 mm). Increased thickness portion TP2 (at the interlock arrangement engaging member) is about 0.094 inches (2.39 mm) with an increased thickness TI2 of about 0.022 inches (0.559 mm) on each side of the engaging member. In another example embodiment, the brush element of FIG. 26*b* could be made thicker, including a center portion thickness TC2 of about 0.062 inches (1.57 mm). Increased thickness portion TP2 (at the interlock arrangement engaging member) is about 0.120 (3.05 mm) inches with an increased thickness TI2 of about 0.016 inches (0.406 mm) on each side of the engaging member. One skilled in the art will recognize that the brush elements and segments of the present disclosure can be made with a variety of combinations of parameters, for example, bristle size and shape, disc radius, center portion thickness, and the forgoing examples are for illustrative purposes.

As discussed previously, brush elements, brush segments, and brush assemblies according to the present disclosure can be used to refine a surface. One example embodiment of a method of refining a surface includes one or more of the following: removing a portion of a workpiece surface; imparting a surface finish to a workpiece; cleaning a workpiece surface, including removing paint or other coatings, gasket material, corrosion, or other foreign material; or some combination of the foregoing. In one example embodiment illustrated in FIG. 13*b*, brush assembly 200 comprises a plurality of brush elements 30 fastened by an attachment means to a shaft and a suitable drive means. Alternatively, the elements 30 can be mounted to a suitable rotary drive means, such as commercially available right angle grinders. Surface refining can be dry or wet, as with water, lubricant, rust inhibitor, or other suitable liquids, as is well known in the art. The brush assembly 200 can be rotated at any suitable speed, desirably in the range up to 15,000 RPMs or as low as 100 RPMs, although higher or lower speeds can be used as desired. Surface refinement can be performed with any suitable force on the brush assembly or segment, typically up to about 100 kg and as low as 0.5 kg, though more or less force may be used. It should be noted that the bristles 38 are sufficiently flexible and supple that, under many refining operations, contact of the bristle against the workpiece is along a substantial length of the side of the bristle, not merely a small portion of the bristle immediately adjacent the tip 134. By using organic abrasive particles described herein, or by omitting abrasive particles 41, the molded brush segment or brush assembly can be used to remove a foreign material, for example paint, dirt, debris, oil, oxide coating, rust, adhesive, gasket material and the like, from a workpiece surface without removing a significant amount of material from the workpiece itself.

The present disclosure has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the disclosure. For example, the molded brush segment according to the present disclosure may be provided with means for introducing fluid such as coolants, lubricants, and cleaning fluids to the workpiece during operation as is known in the art, such as by openings through the backing or bristles. Thus, the scope of the present disclosure should not be limited to the exact details and structures described herein, but rather by the structures described by the language of the claims, and the equivalents of those structures.

Although specific embodiments have been illustrated and described herein for purposes of description, it will be appreciated by those of ordinary skill in the art that a wide variety of alternate and/or equivalent implementations calculated to achieve the same purposes may be substituted for the specific embodiments shown and described without departing from the scope of the present disclosure. Those with skill in the chemical, mechanical, electromechanical, electrical, and computer arts will readily appreciate that the present disclosure may be implemented in a very wide variety of embodiments. This application is intended to cover any adaptations or variations of the exemplary embodiments discussed herein. Therefore, it is manifestly intended that this disclosure be limited only by the claims and the equivalents thereof.

What is claimed is:

1. A molded brush element for a radial brush comprising:

a circular center portion having an outer edge and an inner edge;

a plurality of bristles extending from the outer edge; and an interlock arrangement located at the inner edge, configured to interlock the brush element with a second brush element, the interlock arrangement comprises at least one engaging member.

2. The molded brush element of claim 1, where the interlock arrangement comprises at least one receiving area extending from the inner edge.

3. The molded brush element of claim 2, where the receiving area includes a regular geometrical shape.

4. The molded brush element of claim 3, where the receiving area is partially circular-shaped.

5. The molded brush element of claim 2, wherein the engaging member is positioned along the inner edge, between the first receiving area and a second receiving area.

6. The molded brush element of claim 5, wherein the engaging member includes an inner edge located between a first corner and a second corner.

7. The molded brush element of claim 6, wherein the first corner and the second corner are radiused corners.

8. The molded brush element of claim 5, wherein the engaging member has a first width, and the first receiving area has a second width along the inner edge, and further wherein the first width is substantially equal to the second width.

9. The molded brush element of claim 5, wherein the engaging member has an increased thickness at the inner edge relative to a thickness of the center portion near the outer edge.

10. The molded brush element of claim 9, where the increased thickness is up to 50 percent thicker than the thickness of the center portion at the outer edge.

11. The molded brush element of claim 1, wherein the center portion includes at least two brush segments, and further wherein each brush segment includes a first side edge and a second side edge, and further including a first side attachment arrangement located at the first side edge and a second side attachment arrangement located at the second side edge.

12. The molded brush element of claim 1, wherein the molded brush element is made from a moldable polymeric material.

13. The molded brush element of claim 12, further including abrasive particles.

14. The molded brush element of claim 12, wherein the polymeric material is a thermoplastic polymeric material.

15. The molded brush element of claim 12, wherein the polymeric material is a thermoset polymeric material.

16. The molded brush element of claim 1, wherein the interlock arrangement is configured to lock with a hub member of a rotary tool.

17. A method of making a molded brush element comprising:

defining a mold structure for molding a brush element having a generally planar center portion having an outer edge and an inner edge, a plurality of bristles extending from the outer edge, and an interlock arrangement including an increased thickness portion located at the inner edge, configured to interlock the molded brush element with a second molded brush element;

heating a moldable polymer to form a flowable material; and injecting the flowable material under pressure into the mold structure to form a brush element.

18. The method of claim 17:

wherein said step of defining a mold structure includes defining a mold structure with a gate located to direct material flow through the increased thickness portion; and wherein said step of injecting the flowable material includes injecting the flowable material through the gate.

19. A brush assembly comprising:

a plurality of molded brush elements, each of the molded brush elements comprising:

a generally planar center portion having an outer edge and an inner edge;

a plurality of bristles extending from the outer edge; and an interlock arrangement located at the inner edge, configured to interlock adjacent brush elements.

20. The brush assembly of claim 19, the interlock arrangement comprising:

one or more receiving areas extending from the inner edge into the generally planar center portion; and a number of engaging members, equal to the number of receiving areas, positioned along the inner edge.

21. The brush assembly of claim 19, wherein the interlock arrangement is configured to circumferentially interlock a first brush element with a second brush element, whereby the first and second brush elements are restrained from rotating relative to each one another.

22. A molded brush assembly comprising:

a first molded brush element comprising:

a generally planar first element center portion having a first element outer edge and a first element inner edge;

a plurality of bristles extending from the first element outer edge; and a first interlock arrangement located at the first element inner edge, a second molded bush element comprising:

a generally planar second element center portion having a second element outer edge and a second element inner edge;

a plurality of bristles extending from the second element outer edge; and a second interlock arrangement located at the second element inner edge, the first interlock and the second interlock configured to interlock the first molded brush element with the second molded brush element.

23. A molded brush element comprising:

a plurality of interlocked molded brush segments, each of the molded brush segments comprising:

a generally planar center portion having an outer edge and an inner edge, a first side edge and a second side edge, including a first side attachment arrangement located at the first side edge and a second side attachment arrangement located at the second side edge;

a plurality of bristles extending from the outer edge; and an interlock arrangement located at the inner edge, wherein the plurality of molded brush segments are interlocked at the first side interlock mechanism and the second side interlock mechanism to form a circular shaped molded brush assembly.

24. A rotary brush assembly comprising:

at least two brush elements, each brush element including:

a plurality of interlocked molded brush segments, each of the molded brush segments comprising:

a generally planar center portion having an outer edge and an inner edge, a first side edge and a second side edge, including a first side interlock mechanism located at the first side edge and a second side interlock mechanism located at the second side edge;

a plurality of bristles extending from the outer edge; and an interlock arrangement located at the inner edge;

wherein the plurality of molded brush segments are interlocked at the first side interlock mechanism and the second side interlock mechanism to form a circular shape.

25. A molded brush stack comprising:

a plurality of molded brush assemblies stacked adjacent each other, each molded brash segment comprising a plurality of interlocked molded brush segments, each of the molded brush segments comprising:

a generally planar center portion having an outer edge and an inner edge, a first side edge and a second side edge, including a first side interlock arrangement located at the first side edge and a second side interlock mechanism located at the second side edge;

a plurality of bristles extending from the outer edge; and an interlock arrangement located at the inner edge;

wherein the plurality of molded brush segments are interlocked at the first side interlock arrangement and the second side interlock mechanism to form a circular shaped molded brush assembly.

26. A molded brush segment comprising:

a generally planar center portion having an outer edge and an inner edge;

a plurality of bristles extending from the outer edge, the-bristles integrally molded with the generally planar center portion, each bristle including a root portion adjacent the outer edge, where adjacent root portions define a semi-circular shaped area at the outer edge.

27. The brush segment of claim 26, where the plurality of bristles extend substantially radially from the outer edge.

28. The brush segment of claim 27, wherein the plurality of bristles extending substantially radially are generally arc-shaped.

29. The brush segment of claim 27, wherein each segment includes 54 regularly spaced bristles.

30. A rotary brush segment comprising:

an arcuate center section, the center section including first and second side edges, the center section further including inner and outer edges extending between the first and second side edges;

a first attachment arrangement on the first edge and a second attachment arrangement on the second edge; and an interlock arrangement on the inner edge.

31. The brush segment of claim 30, wherein the arcuate center section is a quarter circle shaped section.

32. The brush segment of claim 31, wherein the bristles are arranged in two rows along the outer edge.

33. The brush segment of claim 31, wherein the bristles are curved bristles.

34. The brush segment of claim 31, wherein the bristles include abrasive particles.

35. The brush segment of claim 30, wherein the brush segment is made from a thermoplastic material.

36. The brush segment of claim 35, wherein the thermoplastic material is thermoplastic elastomeric material.

37. A brush assembly comprising:

a first and a second molded brush element, each molded brush element including:

a generally planar portion having an inner edge and an outer edge, the planar portion having a first and a second surface;

a plurality of bristles extending outwardly from the outer edge;

an interlock arrangement disposed at the inner edge;

at least one raised member extending from the first surface of each element;

a cavity corresponding to each raised member, located on the second surface opposite where each raised member is located; and wherein the interlock arrangements cooperate to keep the first and second elements from rotating relative to each other and each raised member on the first element is received into a corresponding cavity on the second element.

38. The brush assembly of claim 37, further including an adhesive material between the first and second elements.

39. The brush assembly of claim 37, wherein each brush assembly includes a radially spaced array of equidistantly spaced raised members.

40. The brush assembly of claim 39, wherein the raised members are spaced at 22.5 degree intervals.

41. The brush assembly of claim 37, wherein the raised members are circularly shaped.

42. A molded brush element comprising:

a generally planar portion having an inner edge and an outer edge, the planar portion having a first and a second surface;

a plurality of bristles extending outwardly from the outer edge;

an interlock arrangement disposed at the inner edge;

a plurality of raised members extending from the first surface;

a cavity corresponding to each raised member, each cavity located on the second surface opposite where each raised member is located.

43. The brush element of claim 42, wherein each brush element includes an array of equidistantly spaced raised members.

44. The brush element of claim 43, wherein the raised members are spaced at 22.5 degree intervals.

45. The brush element of claim 42, wherein the raised members are circularly shaped.

46. The brush element of claim 42, wherein the brush element includes at least two brush segments.

47. The brush element of claim 46, wherein the brush element includes four congruently shaped brush segments.

48. The brush element of claim 46, wherein each brush element includes an attachment arrangement for attaching each segment to at least one adjacent segment.

* * * * *

UNITED STATES PATENT AND TRADEMARK OFFICE

CERTIFICATE OF CORRECTION

PATENT NO. : 7,121,937 B2
APPLICATION NO. : 10/389788
DATED : October 17, 2006
INVENTOR(S) : Steven E. Turch It is certified that error appears in the above-identified patent and that said Letters Patent is hereby corrected as shown below:

Title page,
Item [56], References Cited, OTHER PUBLICATIONS, delete "Verlag" and insert -- Verlag, -- therefor.
Item [56], References Cited, under U.S. PATENT DOCUMENTS, Page 2, Second column line 6, after "6,431,971" delete "B1" and insert -- B2 -- therefor.
Item [56], References Cited, under U.S. PATENT DOCUMENTS, Page 2, Second column, line 7, after "6,730,140" delete "B1" and insert -- B2 -- therefor.

Column 6
Line 67, delete "TI" and insert -- T1 -- therefor.

Column 9
Line 58, After "that" delete "the".

Column 11
Line 1, delete "542,595" and insert -- 5,427,595 -- therefor.
Line 2, After "reference" insert -- . --.
Line 39, delete "trihydirate," and insert -- trihydrate, -- therefor.

Column 14
Line 11, before "example" delete "a" and insert -- an -- therefor.

Column 15
Line 63, delete "electromechanical," and insert -- electro-mechanical, -- therefor.

Column 17
Line 8, in Claim 18, delete "17:" and insert -- 17. -- therefor.
Line 44, in Claim 22, delete "bush" and insert -- brush -- therefor.

UNITED STATES PATENT AND TRADEMARK OFFICE

CERTIFICATE OF CORRECTION

PATENT NO. : 7,121,937 B2
APPLICATION NO. : 10/389788
DATED : October 17, 2006
INVENTOR(S) : Steven E. Turch It is certified that error appears in the above-identified patent and that said Letters Patent is hereby corrected as shown below:

Column 18

Line 22, in Claim 25, delete "brash" and insert -- brush -- therefor.

Line 41, in Claim 26, delete "the-bristles" and insert -- the bristles -- therefor.

Signed and Sealed this

Seventh Day of August, 2007

JON W. DUDAS

*Director of the United States Patent and Trademark Office*